US012799744B2

(12) United States Patent
Labuz et al.

(10) Patent No.: US 12,799,744 B2
(45) Date of Patent: Nov. 17, 2026

(54) JOINT IN A BUILDING SECTION

(71) Applicant: James Hardie Technology Limited, Dublin (IE)

(72) Inventors: Anna Labuz, Sydney (AU); Anthony Milostic, Sydney (AU); Jeremy McCandless, Sydney (AU); Cameron Mills, Sydney (AU); Peter Pagones, Sydney (AU); William Hendarta, Sydney (AU)

(73) Assignee: James Hardie Technology Limited, Dublin (IE)

( * ) Notice: Subject to any disclaimer, the term of this patent is extended or adjusted under 35 U.S.C. 154(b) by 119 days.

(21) Appl. No.: 18/264,409

(22) PCT Filed: Feb. 8, 2022

(86) PCT No.: PCT/EP2022/053038

§ 371 (c)(1),
(2) Date: Aug. 4, 2023

(87) PCT Pub. No.: WO2022/167693

PCT Pub. Date: Aug. 11, 2022

(65) Prior Publication Data

US 2024/0044148 A1 Feb. 8, 2024

(30) Foreign Application Priority Data

Feb. 8, 2021 (AU) ..... 2021900291
May 5, 2021 (AU) ..... 2021901342

(51) Int. Cl.

| | |
|---|---|
| ***E04F 13/08*** | (2006.01) |
| ***E04F 13/14*** | (2006.01) |
| ***E04F 15/02*** | (2006.01) |

(52) U.S. Cl.
CPC ..... *E04F 13/0894* (2013.01); *E04F 13/148* (2013.01); *E04F 15/02005* (2013.01); *E04F 15/02038* (2013.01); *E04F 2201/023* (2013.01)

(58) Field of Classification Search
CPC ..... E04F 13/0894; E04F 13/148; E04F 15/02005; E04F 2201/023; E04F 13/0889;
(Continued)

(56) References Cited

U.S. PATENT DOCUMENTS 525,442 A * 9/1894 Burrows ..... E04F 13/0864 52/539
6,421,970 B1 * 7/2002 Martensson ..... E04F 13/0878 52/592.1

(Continued)

FOREIGN PATENT DOCUMENTS

DE 10 2004 020645 B4 9/2009
DE 10 2014 003260 A1 9/2015

(Continued)

OTHER PUBLICATIONS

International Search Report mailed May 13, 2022 in International Application No. PCT/EP2022/053038, in 7 pages.

*Primary Examiner* — Gisele D Ford
(74) *Attorney, Agent, or Firm* — Knobbe, Martens, Olson & Bear, LLP

(57) ABSTRACT

A first building panel (110) and at least a second building panel (120) fixed to a building substructure (300) in a predetermined arrangement thereby forming a joint profile (150). Each of the first and at least second building panel comprise a first profiled side edge (140) and a second profiled side edge (145) which are of complementary configuration such that the first profiled side edge of the first building panel is configured to engage with the second profiled side edge of the at least second building panel. The first and second profiled side edge being further configured (Continued)

to form an engineered adhesive reservoir (155) therebetween when the first profiled side edge and second profiled side edge are engaged together. The joint profile further comprising a structural adhesive (285) at least substantially filling the engineered adhesive reservoir.

19 Claims, 10 Drawing Sheets

(58) Field of Classification Search
CPC .. E04F 13/0896; E04F 13/0898; E04B 1/6801
See application file for complete search history.

(56) References Cited

U.S. PATENT DOCUMENTS 7,896,571 B1* 3/2011 Hannig ..... B27F 1/04 403/339
9,140,018 B2* 9/2015 Southwell ..... E04F 13/0817
9,752,328 B2* 9/2017 Everhart, II ..... E04F 13/0894
11,091,917 B2* 8/2021 MacPherson ..... E04F 13/0864
2001/0024707 A1 9/2001 Andersson et al.
2001/0034991 A1* 11/2001 Martensson ..... E04B 1/6129 52/578
2004/0211144 A1* 10/2004 Stanchfield ..... E04F 13/08 52/311.1
2004/0231252 A1 11/2004 Benjamin et al.
2005/0204676 A1* 9/2005 Weitzer ..... E04F 15/04 52/592.1
2005/0221047 A1* 10/2005 Weitzer ..... E04F 15/04 428/60
2006/0165940 A1 7/2006 Sjoberg et al.
2009/0126308 A1* 5/2009 Hannig ..... B27F 1/04 52/588.1
2012/0317909 A1* 12/2012 MacKenzie ..... E04F 13/0803 52/698
2015/0218812 A1* 8/2015 Kell ..... E04F 15/04 428/99
2016/0060878 A1* 3/2016 Everhart, II ..... E04F 13/148 52/588.1
2018/0038109 A1* 2/2018 Kennedy ..... E04D 3/352
2018/0058076 A1* 3/2018 Horton ..... E04F 13/0894
2018/0266121 A1* 9/2018 Meersseman ..... E04F 15/02038
2019/0211566 A1 7/2019 Horton et al.
2019/0211568 A1* 7/2019 Nilsson ..... E04F 15/02005
2020/0181923 A1* 6/2020 Quist ..... E04F 15/02155
2021/0198901 A1* 7/2021 Josefsson ..... B32B 27/302
2021/0214952 A1* 7/2021 Boucké ..... E04F 15/105
2021/0310256 A1* 10/2021 Boo ..... E04F 13/0894
2021/0381251 A1* 12/2021 Svensson ..... E04F 13/0894
2022/0243482 A1* 8/2022 Landgård ..... B32B 21/13
2022/0298081 A1* 9/2022 Brunton ..... E04F 15/08
2024/0125129 A1* 4/2024 Fahle ..... E04F 15/02038

FOREIGN PATENT DOCUMENTS

EP 0 733 756 A2 9/1996
EP 3 584 387 A1 12/2019
WO WO 2020/260721 A1 12/2020

* cited by examiner

JOINT IN A BUILDING SECTION

CROSS-REFERENCE TO RELATED APPLICATIONS

This application is the U.S. National Phase of International Application No. PCT/EP2022/053038, filed 8 Feb. 2022, entitled "AN IMPROVED JOINT IN A BUILDING SECTION", which claims the benefit of Australian Provisional Application Serial No 2021900291, filed 8 Feb. 2021, entitled "AN IMPROVED JOINT IN A BUILDING SECTION" and Australian Provisional Application Serial No 2021901342, filed 5 May 2021, entitled "AN IMPROVED JOINT IN A BUILDING SECTION", each of which are hereby incorporated by reference in their entirety and for all purposes.

FIELD

The present disclosure generally relates to building construction, and in particular, improved joints in constructed building sections.

SUMMARY OF THE DISCLOSURE

Cladding materials are applied to building structures to protect the building structure and/or to provide an aesthetic finish to the exterior or interior of the building structure. The cladding materials can be in the form of boards, panels, shingles, planks or the like. In the present disclosure, a cladding material is sometimes referred to as a cladding panel and/or a building panel. Usually, such cladding materials are attached as a system to a surface of a building structure whereby the building structure is usually a structural building frame comprising a series of vertical and horizontal framing members. The vertical framing members are commonly referred to as studs. In one particular example, cladding materials are configured and attached to the building structure in one or more rows whereby the external surfaces of said cladding materials are parallel and co-planar in a shiplap or tongue and groove type configuration, thereby providing the appearance of a 'flat wall'. Such cladding systems are known as 'flat wall cladding'.

During installation, cladding materials such as, for example, building panels are usually attached to the building structure such that the join or joint between adjacent building panels occurs directly over a stud, referred to as 'on-stud' fixing. The stud provides extra support to the cladding materials at joints which in turn provides better resistance to external forces such as, for example, wind-loading. This installation practice can prove to be cumbersome and time consuming for a cladding installer, particularly in the event of misalignment of studs within the structural building frame. In such an event, the cladding installer must try re-align the studs or install additional battens to proceed further with an 'on-stud' installation of the cladding materials, which is costly and time-consuming.

It may be desirable to provide an improved joint between adjacent cladding materials which provides better resistance to external forces when constructing an improved building section in a flat wall cladding system. It may also be desirable for the improved joint between adjacent cladding materials to be suitable for installation in an 'on-stud' or 'off-stud' fixing arrangement, whereby an 'off-stud' fixing arrangement is the converse of an 'on-stud' fixing arrangement, i.e. in an 'off-stud' fixing arrangement, the joint or join between adjacent panels does not occur directly over a stud.

The systems and methods described herein have a variety of innovative aspects, no single one of which is indispensable or solely responsible for their desirable attributes. Without limiting the scope of the claims, the summary below describes some of the advantageous features.

According to the present disclosure, there is provided an improved joint in a building section comprising:

- a building substructure;
- a first building panel and at least a second building panel wherein the first and at least second building panel are fixed to the building substructure in a predetermined arrangement,
  - each of the first and at least second building panel comprising a first profiled side edge and a second profiled side edge wherein the first and second profiled side edges are opposing side edges and are of complementary configuration such that the first profiled side edge of the first building panel is configured to engage with the second profiled side edge of the at least second building panel thereby forming a joint profile,
    - the first and second profiled side edge being further configured to form an engineered adhesive reservoir therebetween when the first profiled side edge and second profiled side edge are engaged together; and
- a structural adhesive wherein the structural adhesive is located within the engineered adhesive reservoir.

In one embodiment, the first building panel and the at least second building panel are fixed to the building substructure such that the first profiled side edge of the first building panel and the second profiled side edge of the at least second building panel are engaged together to form the improved joint between the first building panel and the at least second building panel. In the following disclosure, the engagement of the first profiled side edge of the first building panel and the second profiled side edge of the at least second building panel together to form the improved joint, can also be described as the first profiled side edge of the first building panel and the second profiled side edge of the at least second building panel seating together to form the improved joint. It should also be understood that it is possible to seat the second profiled side edge of the first building panel and the first profiled side edge of the at least second building panel together to form the improved joint. For the purposes of the present disclosure the configuration of the first profiled side edge and/or the second profiled side edge respectively are also referred to as a joint profile the first profiled side edge and/or the second profiled side edge respectively.

According to the present disclosure, there is also provided an improved building panel for use in a building section comprising:

- a building panel comprising a first profiled side edge and a second profiled side edge wherein
- the first and second profiled side edges are opposing side edges,
  - the first profiled side edge of a first building panel is configured to engage with the second profiled side edge of a second building panel thereby forming a joint profile,
  - the first profiled side edge of a first building panel and second profiled side edge of a second building panel being further configured to form an engineered adhesive reservoir therebetween when the first profiled side edge of the first building panel and second profiled side edge of the second building panel are engaged together.

In one embodiment, the joint profile of the first profiled side edge and/or the second profiled side edge comprises at least one scarfed joint section. In a further embodiment, the joint profile of the first profiled side edge and/or the second profiled side edge comprises two scarfed joint sections. In another embodiment, the joint profile of the first profiled side edge and/or the second profiled side edge comprises an interlock joint section wherein the interlock joint section is a tabled splice joint section or a tongue and groove joint section. In a further embodiment the joint profile of the first profiled side edge and/or the second profiled side edge comprises a hybrid joint profile. In one embodiment, the hybrid joint profile comprises at least one scarfed joint section and at least an interlock joint section wherein the interlock joint section is either a tabled splice joint section or a tongue and groove joint section. In another embodiment, the hybrid joint profile comprises at least two scarfed joint sections and at least an interlock joint section wherein the interlock joint section is either a tabled splice joint section or a tongue and groove joint section wherein at least two scarfed joint sections are spaced apart from each other and the interlock joint section is intermediate the spaced apart at least two scarfed joint sections.

In one embodiment, the engineered adhesive reservoir comprises at least a first adhesive reservoir section. In a further embodiment, the engineered adhesive reservoir comprises at least a first adhesive channel. In one embodiment, the structural adhesive is located in the engineered adhesive reservoir, and substantially fills the engineered adhesive reservoir. In one embodiment, the structural adhesive both the first adhesive reservoir section and the at least a first adhesive channel. In further embodiments, the structural adhesive completely fills the engineered adhesive reservoir.

In one embodiment, the structural adhesive is selected from one or more of the group comprising two-part epoxy, two part polyurethane, and single part polyurethane adhesives. In a further embodiment, the two-part epoxy adhesive is a toughened epoxy. The structural adhesive together with the configuration of the joint profile of the first profiled side edge and/or the second profiled side edge synergistically combine to provide a strong fused joint which seamlessly connects two adjacent building panels together in which the fused building panels behave mechanically as one panel rather than two separate adjacent panels. The fused building panels provide better resistance to external forces such as, for example wind loading. The improved joint between the fused building panels also enables an installer to utilise 'off-stud' joining between panels thereby eliminating the need for a cladding installer to make adjustments to studs or install new studs or battens for 'on-stud' joining without compromising the mechanical properties of the building section.

Traditional butt joints are commonly recognised as a simple joint, in which two building panels are brought together or joined by simply having the edge of one building panel touch the edge of the adjacent building panel. The side edges of such building panels are usually perpendicular and contiguous to the main faces of a building article. In the embodiments of the present disclosure, as generally described above, the configuration of the first profiled side edge and/or the second profiled side edge advantageously provide a lateral offset within the side edge profile. When the first building panel and at least second building panels are seated together to form the joint profile, the lateral offset of the first profiled side edge and/or the second profiled side edge provide an indirect or contorted pathway between the opposing major faces of a building panel. The advantage of an indirect or contorted pathway in the joint profile of the present disclosure is that the fracture initiation and/or propagation energy of the adhesive bond formed by the structural adhesive within joint profile is raised. Thus, greater energy is required to break the adhesive bond of the joint configuration of the present disclosure during any joint stress events when compared to a traditional butt joint.

In one embodiment, the first and at least second building panel of the present disclosure are fibre cement. In further embodiments, the first and at least second fibre cement building panels are configured to be installed on the building substructure in a manner such that major external surfaces of adjacent fibre cement building panels are parallel and coplanar to create the appearance of a clean, smooth and flat surface. In one or more embodiments, the first and at least second fibre cement building panels are manufactured using a Hatschek process.

In one embodiment, one or more of the building panels further comprise an aesthetic finish on at least a section of at least one major face, wherein the aesthetic finish comprises one or more of the group comprising textures, patterns, profiles, visual indicia and/or a decorative finish. In some embodiments, the decorative finish is in the form of an applied coating material including for example, paint or a digital print. In a further embodiment, the aesthetic finish is applied to at least one building panel. In one embodiment, the aesthetic finish is printed onto at least one building panel. In an alternate embodiment, the aesthetic finish is embossed into at least one building panel. In a further embodiment the aesthetic finish is integrally formed in at least one building panel. In an alternative embodiment, the aesthetic finish is machined into at least one building panel. In a further embodiment, each individual building panel can contain one or more face grooves extending across the surface of at least one major face.

According to the present disclosure there is also provided an improved joint in a building section comprising:

a building substructure;

a first building panel and at least a second building panel wherein the first and at least second building panel are fixed to the building substructure in a predetermined arrangement, each of the first and at least second building panel comprising a first profiled side edge and a second profiled side edge wherein the first and second profiled side edges are opposing side edges and are of complementary configuration such that the first profiled side edge of the first building panel is configured to engage with the second profiled side edge of the at least second building panel thereby forming a joint profile, wherein the joint profile comprises a hybrid joint profile, the hybrid joint profile comprising at least two scarfed joint sections and at least an interlock joint section wherein the interlock joint section is either a tabled splice joint section or a tongue and groove joint section wherein at least two scarfed joint sections are spaced apart from each other and the interlock joint section is intermediate the spaced apart at least two scarfed joint sections; and the first and second profiled side edge being further configured to form an engineered adhesive reservoir therebetween when the first profiled side edge and second profiled side edge are seated together.

According to the present disclosure there is further provided a cladding system comprising:

a building structural substrate, at least two building panels, each fixed to the building structural substrate in a predetermined arrangement adjacent another building panel thereby forming a building section, and at least one improved joint formed between any two adjacent building panels in a building section.

According to the present disclosure, there is provided a method of installing an improved building section comprising the steps of:

providing a building structural support;

providing a first building panel comprising a first and a second profiled side edge and installing by fixing it to the building structural support in a predetermined position;

applying an uncured structural adhesive to the first profiled side edge;

providing a second building panel comprising a first and a second profiled side edge and installing by:

engaging its complementary profiled second profiled side edge with the first profiled side edge of the first building panel to form an engineered adhesive reservoir, aligning the panel to a predetermined position, urging the second profiled side edge of the second building panel and the first profiled side edge of the first building panel together so that the uncured structural adhesive at least substantially fills the engineered adhesive reservoir, forming a joint line between adjacent building panels, and fixing the second building panel to the building substructure in a predetermined position;

for any additional building panels required to complete construction of a desired building section, applying uncured structural adhesive to the respective first profiled side edge of a previously installed building panel, repeating the previous step, and allowing the structural adhesive to cure.

In one embodiment, the first profiled side edge and/or the second profiled side edge comprises at least one scarfed joint section. In a further embodiment, the first profiled side edge and/or the second profiled side edge comprises two scarfed joint sections. In another embodiment, the first profiled side edge and/or the second profiled side edge comprises an interlock joint section wherein the interlock joint section is a tabled splice joint section or a tongue and groove joint section. In a further embodiment the first profiled side edge and/or the second profiled side edge comprises a hybrid joint profile. In one embodiment, the hybrid joint profile comprises at least one scarfed joint section and at least an interlock joint section wherein the interlock joint section is either a tabled splice joint section or a tongue and groove joint section. In another embodiment, the hybrid joint profile comprises at least two scarfed joint sections and at least an interlock joint section wherein the interlock joint section comprises either a tabled splice joint section or a tongue and groove joint section wherein at least two scarfed joint sections are spaced apart from each other and the interlock joint section is intermediate the spaced apart at least two scarfed joint sections.

In one embodiment, the engineered adhesive reservoir comprises at least a first adhesive reservoir section. In a further embodiment, the engineered adhesive reservoir comprises at least a first adhesive channel.

In one embodiment, the structural adhesive is selected from one or more of the group comprising two-part epoxy, two part polyurethane, and single part polyurethane adhesives. In a further embodiment, the two-part epoxy adhesive is a toughened epoxy.

In one embodiment, the method of installing an improved building section, further comprises the step of removing any excess structural adhesive by wiping or scraping away from the joint line. In a further embodiment, the method of installing an improved building section, further comprises the step of spreading any excess structural adhesive along the first major face of the building panels adjacent the joint line.

In one embodiment, the first and at least second building panel of the present disclosure are fibre cement. In further embodiments, the first and at least second fibre cement building panels are configured to be installed on the building substructure in a manner such that major external surfaces of adjacent fibre cement building panels are parallel and coplanar so as to create the appearance of a clean, smooth and flat surface.

In one embodiment, one or more of the building panels further comprise an aesthetic finish on at least a section of at least one major face, wherein the aesthetic finish comprises one or more of the group comprising shallow textures, patterns, profiles, visual indicia and/or a decorative finish. In some embodiments the decorative finish is in the form of an applied coating material including for example, paint or a digital print. In a further embodiment, the aesthetic finish is applied to at least one building panel. In one embodiment, the aesthetic finish is printed onto at least one building panel. In an alternate embodiment, the aesthetic finish is embossed into at least one building panel. In a further embodiment the aesthetic finish is integrally formed in at least one building panel. In an alternative embodiment, the aesthetic finish is machined into at least one building panel. In a further embodiment, each individual building panel can contain one or more face grooves extending across the surface of at least one major face.

In one embodiment, the method of installing an improved building section, further comprises the step of securing at least one trim element to the building structural support before installing by fixing a first building panel comprising a first and a second profiled side edge. In such an embodiment, the trim element is often referred to as a starting strip. In a further embodiment, the method of installing an improved building section comprises the step of installing one or more further trim elements as required to the building structural support. In another embodiment, the method of installing an improved building section, further comprises the step of providing a weather resistant barrier and or one or more sheathing members on the building structural support before installing a first building panel comprising a first and a second profiled side edge.

For the purposes of this specification, the term 'comprise' shall have an inclusive meaning. Thus, it is understood that it should be taken to mean an inclusion of not only the listed components it directly references, but also non specified components. Accordingly, the term 'comprise' is to be attributable with as broad an interpretation as possible and this rationale should also be used when the terms 'comprised' and/or 'comprising' are used.

Any discussion of the prior art throughout the specification should in no way be considered as an admission that such prior art is widely known of forms part of the common general knowledge in the field.

Further aspects or embodiments of the present disclosure will become apparent from the ensuing description which is given by way of example only.

BRIEF DESCRIPTION OF THE DRAWINGS

Certain embodiments of the present disclosure will now be described, by way of example only, with reference to the accompanying drawings. From FIG. to FIG., the same or similar reference numerals are used to designate similar components of an illustrated embodiment.

DETAILED DESCRIPTION OF THE PREFERRED EMBODIMENTS

Figure 1:
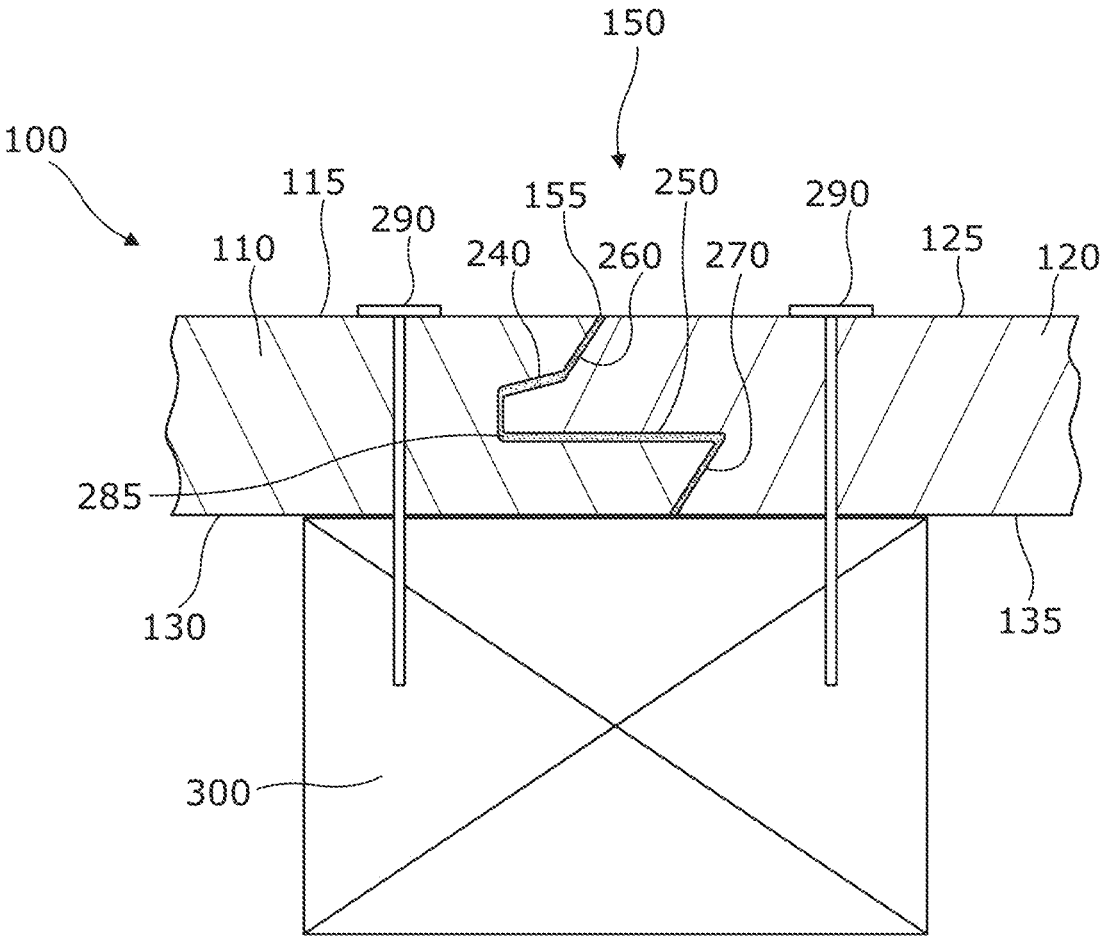
FIG. 1 is a cross-sectional view of an improved joint in a building section according to the present disclosure.

In the description which follows, reference is made to the accompanying drawings, which form a part hereof. In the drawings, similar symbols typically identify similar components, like parts may be marked throughout the specification and drawings with the same reference numerals, unless context dictates otherwise. The illustrative embodiments are not meant to be limiting. Other embodiments may be used, and other changes may be made, without departing from the scope of the subject matter presented herein. The drawing figures are not necessarily to scale and certain features may be shown exaggerated in scale or in somewhat generalized or schematic form in the interest of clarity and conciseness.

An improved joint in a building section, a monolithic cladding incorporating at least one improved joint in a building section, and a method of constructing the improved joint, are provided hereafter in the present disclosure with illustrative examples.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with an improved joint in a building section and are described herein with reference to this application. However, it will be appreciated that the disclosure is not limited to this particular field of use.

Referring now to the drawings and specifically FIG. 1, there is shown one embodiment of an improved joint 150 in a building section 100. In the building section 100, a first building panel 110 and a second building panel 120 are fixed to building structural support or frame member 300 in a predetermined arrangement such that the first building panel 110 and second building panel 120 are nested together in an adjoined arrangement. First and second building panels 110, 120 are secured or fixed to building structural substrate 300 by conventional mechanical fixing methods such as screws, nails, and the like. In the embodiment shown in FIG. 1, fixing is achieved by nails 290. It is understood that alternate fixing methods, such as, for example chemical fixing methods can also be used.

Building structural support 300 usually forms part of a larger structural frame substrate comprising one or more structural framing members. The building structural support 300 and larger structural frame substrate may comprise a timber structural support or structural frame substrate or alternatively a steel structural support or structural frame substrate. Although not shown, it is also understood that a building section in accordance with the present disclosure can further comprise a sheathing layer, for example, OSB board and/or an optional building wrap or building paper applied. The spacing of the building structural support or framing members within the structural frame substrate will be determined by applicable local, regional or national building codes. The type and spacing of any fixings will be determined by locally, regionally or nationally applicable building codes and standards and these should be consulted regarding each intended application.

In the embodiment detailed in the present disclosure, building panels 110, 120 are made from fibre cement. The first and second fibre cement building panels 110, 120 are manufactured using the Hatschek process. Alternative suitable fibre cement manufacturing processes, such as, for example, Flow-on or Fourdrinier or any other suitable manufacturing process known to the skilled person could also be used. It is also understood that first and second building panels 110, 120 can be made from any material suited to the intended application for example, timber, plasterboard or the like may also be suitable. Manufacturer's recommendations should be followed regarding suitability.

Figure 2A:
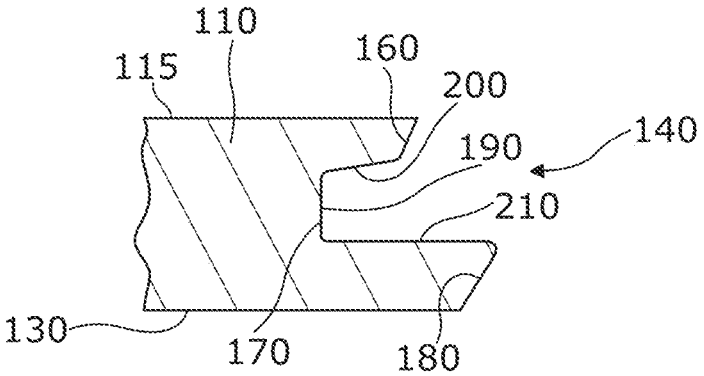
FIG. 2A is a cross-sectional view of the first side edge profile of the joint profile of FIG. 1.
Figure 2B:
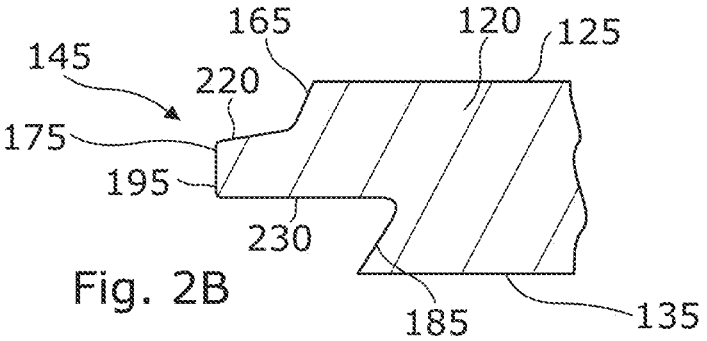
FIG. 2B is a cross-sectional view of the second side edge profile of the joint profile of FIG. 1.

With specific reference to FIGS. 2A and 2B, each of the first and second building panel 110 and 120 comprises a first profiled side edge 140 and an opposing second profiled side edge 145. As shown in FIG. 1, the second profiled edge 145 of the second building panel 120 is configured to seat within the first profiled edge 140 of a first building panel 110 thereby forming the improved joint 150 in building section 100.

As will be discussed further below with respect to FIGS. 2A to 2D, first profiled side edge 140 and second profiled side edge 145 are configured such that the energy required to initiate cracking and breaking of the adhesive bond through the joint is increased. In addition, the first and second profiled side edges 140,145 are further configured to form an engineered adhesive reservoir 155 within the joint profile 150. The engineered adhesive reservoir 155 is configured to accumulate and store structural adhesive 285 such that the structural adhesive 285 can distribute evenly within the improved joint configuration 150 whilst also preventing substantial seepage of the structural adhesive 285 during application.

Figure 2C:
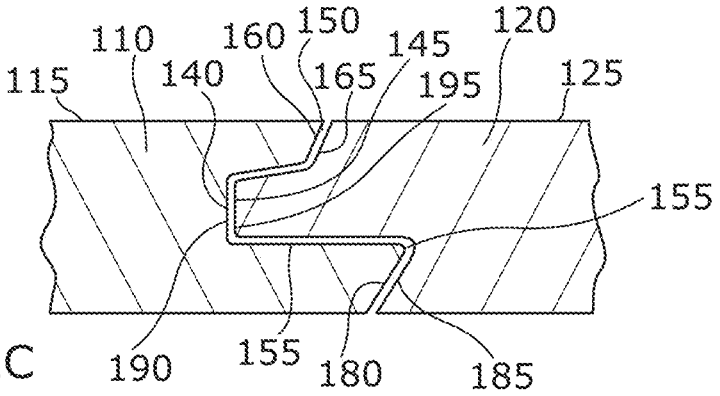
FIG. 2C is a cross-sectional view of the first and second side edge profile of the joint profile of FIG. 1 in complementary engagement.
Figure 2D:
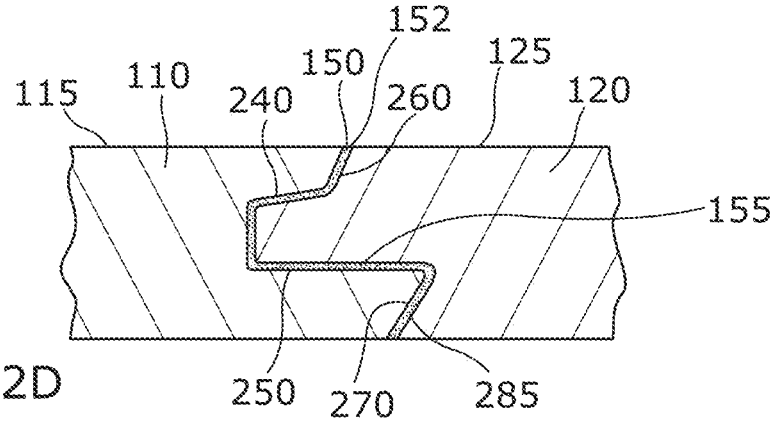
FIG. 2D is a cross-sectional view of the first and second side edge profile of the joint profile of FIG. 1 in complementary engagement with adhesive positioned within the joint profile.

Turning now specifically to FIGS. 2A to 2D, there is shown a first profiled side edge 140 extending between first major face 115 and second major face 130 of first building panel 110 and second profiled side edge 145 extending between first major face 125 and second major face 135 of second building panel 120. The configuration of the first profiled side edge 140 of first building panel 110 and second profiled side edge 145 of second building panel 120 are shown separately in FIGS. 2A and 2B respectively and in an engaged abutting or adjoining relationship in FIG. 2C. FIG. 2D is similar to FIG. 2C in that it shows the first profiled edge 140 of the first building panel 110 engaged with the second profiled edge 145 of the second building panel 120 with the addition of structural adhesive 285 thereby illustrating the profiled edge faces that define the engineered adhesive reservoir 155.

As best shown in FIG. 2A, profiled first side edge 140 of first building panel 110 comprises a plurality of face sections extending between the first major face of the first panel 115 and the second major face of the first panel 130. First joint face section 160 and third joint face section 180 are scarfed joint sections, that is they intersect a major face of a building panel at an angle other than 90 degrees. In joinery terms, when two work pieces are to be joined, a scarfed joint is a created when the side edge faces of each work pieces are not perpendicular to the respective faces of the work pieces but are at an angle. The angles of the faces relative to their respective workpiece are complementary to one another, such that, when the workpieces are joined, the faces of the workpieces are parallel, and optimally are co-planar.

In the embodiment shown in FIG. 2A, the angles of first joint face section 160 and third joint face section 180 are not the same. In an alternate embodiment, such as that shown in FIG. 7, the angles of the first joint face section 460 and third joint face section 480 are the same. In either embodiment, that is where the angles of the first face joint section and third face joint section are the same or different, the angles of the scarf joint sections are optimised to provide the best performance for each application.

As also shown in FIG. 2A, there is a lateral offset between first joint face section 160 and third joint face section 180. The lateral offset ensures that the pathway between first joint face section 160 and third joint face section 180 is an indirect or contorted pathway, thereby raising the fracture propagation energy required during any joint stress events, when compared to a traditional butt joint edge, in which the edge section between opposing major faces of a building panel is generally perpendicular to the planes of opposing major faces of the building panel.

Figure 6A:
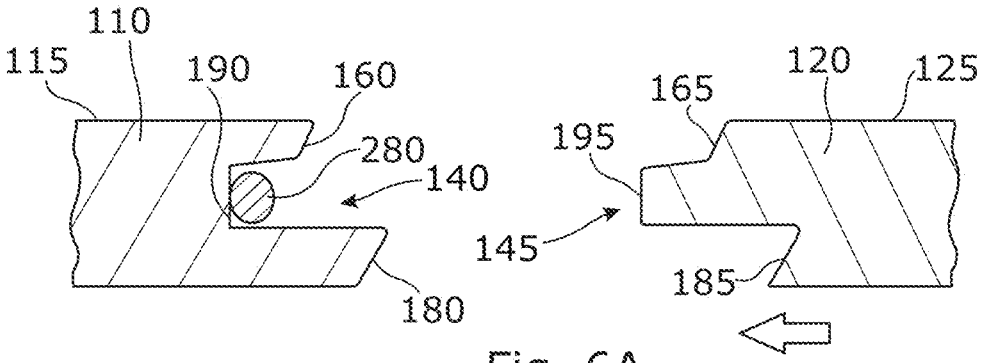
FIGS. 6A to 6D are a series of cross-sectional side views of a method of forming an improved joint between adjacent building panels, showing the steps of: (A) applying the adhesive to a profiled edge before adjacent panel edges are engaged; (B) engagement of panel edges; (C) after engagement of panel edges; and (D) placement of excess adhesive onto front faces of the boards adjacent the join line.
Figure 6B:
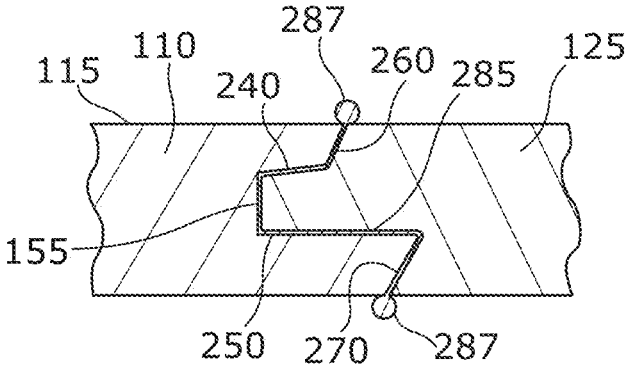
Figure 6C:
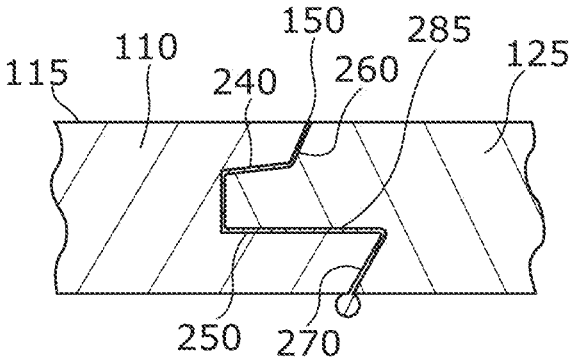
Figure 6D:
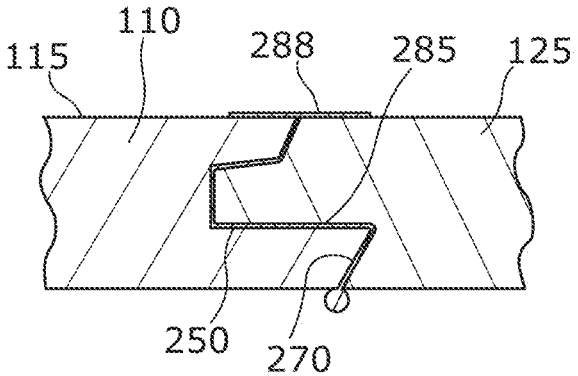

In FIG. 2A, second joint face section 170 is generally in the form of a groove and has three distinct zones. Second joint face section comprises groove first side wall 200, groove base 190, and groove second side wall 210 positioned between the first major face of the first panel 115 and the second major face of the first panel 130. During installation of the improved joint in a building section as described in the present disclosure, groove base 190 acts as a convenient location to receive a bead of structural adhesive 280 as shown in FIG. 6A.

In FIG. 2B, second profiled side edge 145 of second building panel 120 is shown in which second profiled side edge 145 comprises first complementary joint face section 165, second complementary joint face section 175 and third complementary joint face section 185 positioned between the first major face of the second building panel 125 and the second major face of the second panel 135. Each section of second profiled side edge 145 is generally configured such that its shape is complementary to its respective corresponding opposing side face edge of the first panel shown in FIG. 2A. In FIG. 2B, first complementary joint face section 165 and third complementary joint face section 185 are scarfed and are offset from each other by a similar but opposite amount compared to that shown in FIG. 2A. Second complementary joint face section 175 is in the form of a tongue comprising a tongue first side edge 220, a tongue second side edge 230 and a tongue tip 195.

During installation, first profiled side edge 140 of first building panel 110 and second profiled side edge 145 of second building panel 120 are brought together. The complementary configuration of the first 160, 165, second 170, 175 and third 180 and 185 joint face sections respectively of the first and second profile side edges 140, 145, enable the first and second building panels 110, 120 to easily seat together in an adjoining relationship as shown in FIG. 2C, thereby creating an adhesive reservoir 155 within a contorted joint profile 150.

Referring now to FIG. 2D, the length of tongue tip 195 in relation to groove base 190 is used to control the width of any gap or the size of the adhesive reservoir 155 between tongue first side edge 220 and groove first side wall 200 and between tongue second side edge 230 and groove second side wall 210 respectively. The gap between tongue first side edge 220 and groove first side wall 200 and between tongue second side edge 230 and groove second side wall 210 respectively is also referred to as the first adhesive reservoir section 240 and second adhesive reservoir section 250 respectively. The length of the tongue tip 195 also controls the distance between first joint face section 160 and first complementary joint face section 165 and between third joint face section 180 and third complementary joint face section 185 to define a first adhesive channel 260 and a second adhesive channel 270 respectively. First adhesive channel 260, second adhesive channel 270, first adhesive reservoir section 240 and second adhesive reservoir section 250 are together referred to as the engineered adhesive reservoir 155. The visible surface of adhesive reservoir 155 between first major face 115 of first building panel 110 and first major face 125 of second building panel 120 forms joint line 152.

First adhesive reservoir section 240, second adhesive reservoir section 250, first adhesive channel 260 and second adhesive channel 270 which together define engineered adhesive reservoir 155 between first profile side edge 140 and second profile side edge 145 are used for accepting and retaining a predetermined volume of a structural adhesive applied during installation of an improved joint in a building section. The configuration of engineered adhesive reservoir 155 ensures that structural adhesive 285 substantially fills adhesive reservoir 155 and minimal or no air is trapped in the joint during installation, thereby ensuring adequate engagement of the adjacent edges.

Figure 7:
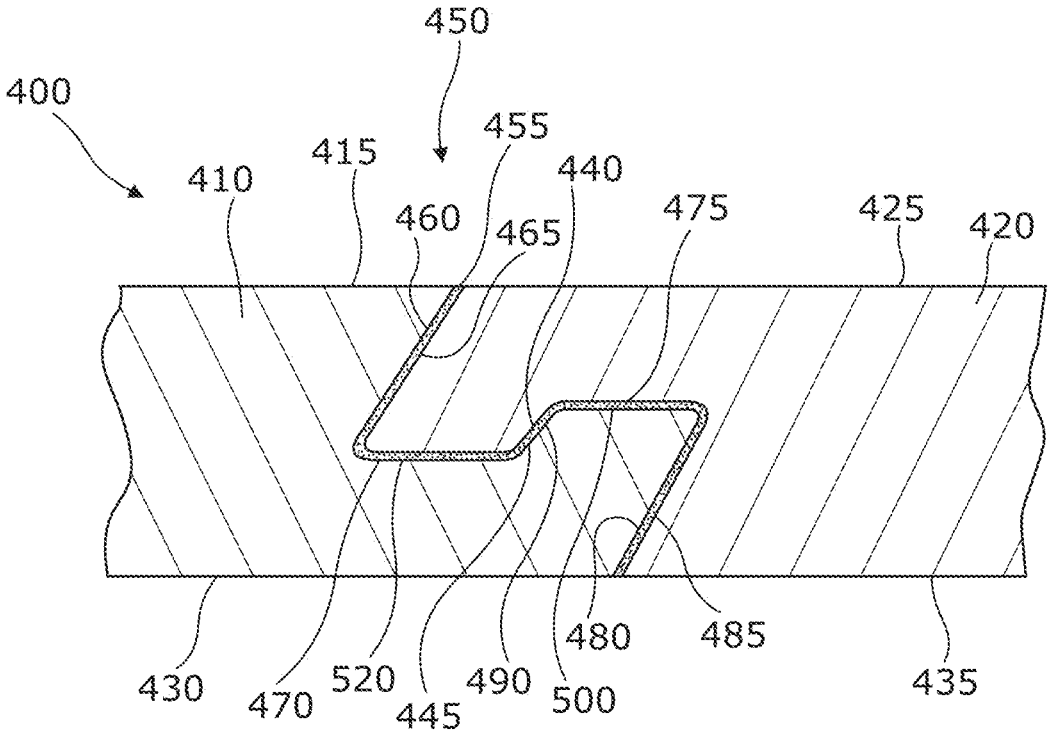
FIG. 7 is a cross sectional view of another improved joint in a building section according to the present disclosure.

As shown in cross-section in FIGS. 1, 2C, and 2D, the improved joint of the present disclosure comprises a hybrid joint profile comprising two scarfed joint section disposed on either side of a tongue and groove joint section, forming a hybrid profile of a scarfed tongue and groove joint line. Turning briefly to FIG. 7, which will be discussed in more detail below, there is shown an alternate embodiment of a hybrid joint profile 450. Similarly, the hybrid joint profile of FIG. 7 comprises first and second opposing profiled side edges 440 and 445 respectively, each of the first and second opposing profiled side edges being configured such that they can seat together to form a hybrid joint profile 450. The hybrid joint profile of FIG. 7 comprises two scarfed joint sections and a tabled splice joint section, wherein the tabled splice joint section is positioned intermediate the scarfed joint sections.

Traditional building panels tend to have either a basic unprofiled "Square" edge or a simple complementary edge profile such as a shiplap joint. In instances where such joints are used together with a high strength adhesive, it is not always possible to resist crack initiation and propagation of an adhesive within the joint profile. In the case of simple butt joints wherein the joint line between two adjacent panels provides the shortest path between the first face of panels and a second face opposing the first face, it is often found that adhesives fail in such a joint due to the stress profile generated. In such examples, failure mode is generally via debonding of the adhesive from the joint face.

In both embodiments of the joint profile of the present disclosure, the reverse offset in the scarf joint sections of joint profile 150, 450 has been designed to modify the stress profile generated within a constructed building section when subject to tensile, shear, flexural or bending stresses. The configuration of the joint profile of the present disclosure contributes to the overall strength of the joint. The synergistic effect of the joint surface area together with a contorted joint line reduces the cleavage stresses normally experienced by adhesive joints and thereby increases the energy required to initiate cracking through the joint which in turn prevents joint failures via debonding of the adhesive from the joint face.

Figure 3A:
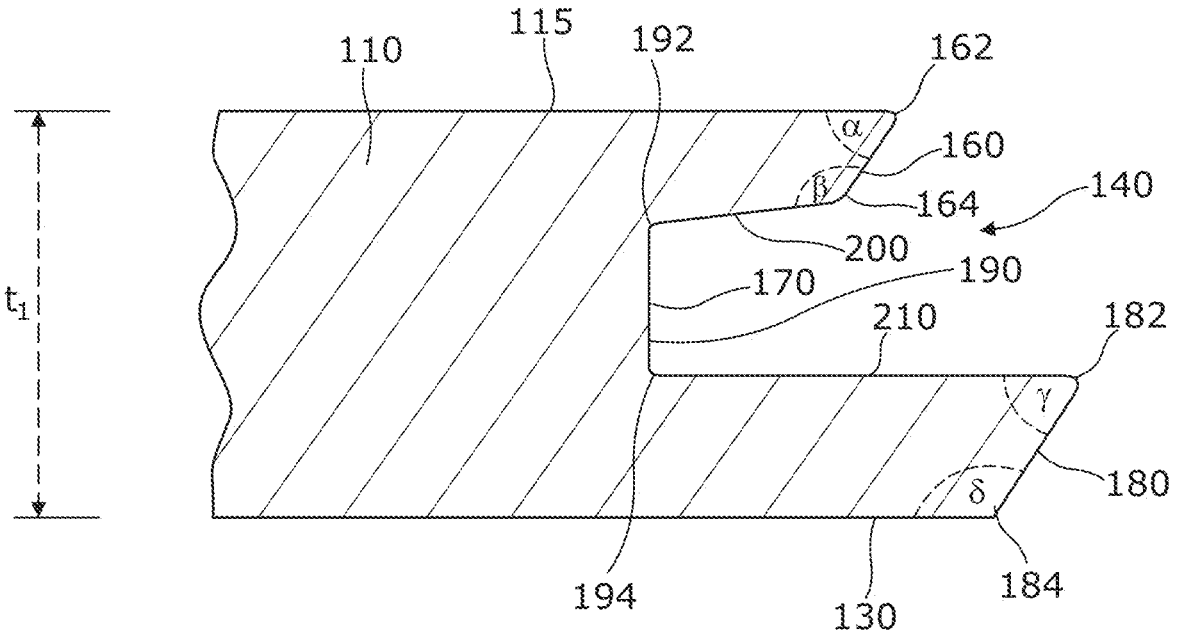
FIG. 3A is an enlarged cross-sectional view of the first side edge profile of the joint profile of FIG. 1.
Figure 3B:
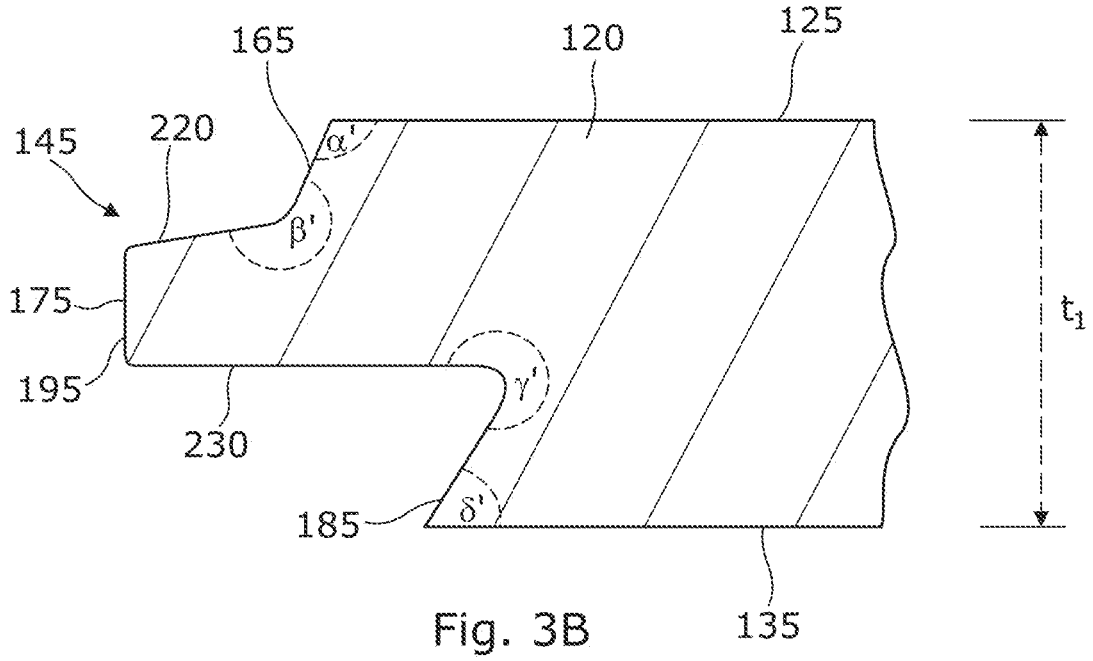
FIG. 3B is an enlarged cross-sectional view of the second side edge profile of the joint profile of FIG. 1.

FIGS. 3A and 3B show an enlarged sectional view of the first and second profile side edge 140, 145 of first and second building panel 110, 120 respectively having a thickness $t_1$. Typically, for a building panel suitable for use as either an internal or external building panel, thicknesses range between approximately 3.5 mm and approximately 20 mm. For an exterior building panel, thickness $t_1$ ranges between approximately 6 mm and approximately 15 mm, and preferably between approximately 8 mm and approximately 12 mm.

As previously described and as shown in FIG. 3A, first profile side edge 140 comprises first joint face section 160, second joint face section 170 and third joint face section 180. First joint face section 160 and third joint face section 180 each comprise a scarfed joint face section whilst second joint face section 170 is a groove comprising groove first side wall 200, groove base 190, and groove second side wall 210. As shown in FIG. 3B, second profile side edge 145 also comprises a first complementary joint face section 165, second complementary joint face section 175 and third complementary joint face section 185 which are complementary in shape to corresponding portions of first profile side edge 140. First complementary joint face section 165 and third complementary joint face section 185 each also comprise a scarfed joint face section whilst second complementary joint face section 175 comprises a tongue first side edge 220, a tongue second side edge 230 and a tongue tip 195.

First joint face section 160 of first profile side edge 140 comprises a scarf angle $\alpha$ in the range of 30 to 80 degrees, 50 to 80 degrees, preferably 55 to 65 degrees and more preferably approximately 58 to 62 degrees with respect to first major face 115. In contrast the scarf angle $\alpha'$ of second profile side edge is in the range between 100 and 150 degrees, 100 to 130 degrees, preferably 115 to 125 degrees and more preferably approximately 118 to 122 degrees with respect to first major face 125 such that irrespective of the actual angle size of $\alpha$ or $\alpha'$, the sum of $\alpha$ and $\alpha'$ is 180 degrees. The angle can be refined based on the properties of the material from which first building panel 110 is manufactured from. The angle is determined to optimise resistance to out-of-plane stresses applied to the improved joint in a constructed building section.

The angle $\beta$ between first joint face section 160 and groove first side wall 200 is in the range of 100 to 160 degrees, preferably 100 to 150 degrees, preferably 120 to 140 degrees, preferably 125 to 135 degrees, and more preferably approximately 128 to 132 degrees. Similarly, the angle iv between first complementary joint face section 165 and tongue first side edge 220 is in the range of 200 to 260 degrees, preferably 210 to 260 degrees, preferably 220 to 240 degrees, preferably 225 to 235 degrees, and more preferably approximately 228 to 232 degrees such that irrespective of the actual angle size of $\beta$ or $\beta'$, the sum of $\beta$ and iv is 360 degrees.

Angle $\gamma$ between groove second side wall 210 and third joint face section 180 may be the same as a or may be different. It too can be optimised for various applications that it is intended to be used for. It is also generally in the range of 30 to 80 degrees. That angle will define the angle $\delta$ the complementary range 100 to 150 degrees. Angle $\gamma'$ which is the obtuse angle created between tongue second side edge 230 and third complementary joint face section 185 is generally in the range of between 280 and 330 degrees such that the sum of angles $\gamma$ and $\gamma'$ together is 360 degrees. It too can be optimised for various applications that it is intended to be used for. The angle $\gamma'$ will define the angle $\delta'$ in the complementary range 30 to 80 degrees.

In one embodiment, groove base 190 of first building panel 110 is substantially flat and is perpendicular relative to first major face 115 of first building panel 110. Groove second side wall 210 may be angled relative to second major face 130 of first building panel 110 or may be substantially parallel to second major face 130. In the embodiment shown in FIG. 3A, groove second side wall 210 is substantially parallel to second major face 130 of first building panel 110. In one embodiment, the angle between groove base 190 and groove second side wall 210 is approximately 90 degrees. Similarly, the tongue first side edge 220 and/or tongue second side edge 230 of second complementary joint face section 175 as shown in FIG. 3B, may be angled relative to second major face 135 of second building panel 120 or may be substantially parallel to second major face 135. In the embodiment shown, the tongue first side edge 220 and/or tongue second side edge 230 of second complementary joint face section 175 is substantially parallel to the second major face 135 of second building panel 120. Tongue tip 195 is substantially flat and perpendicular to first major face 125 of second building panel 120.

In FIG. 3A, first joint face section 160 is laterally offset from third joint face section 180. In a similar manner, the first complementary joint face section 165 is laterally offset from third complementary joint face section 185 as shown FIG. 3B. The lateral offset can be in the range 5 mm to 20 mm, and preferably 7.5 mm to 15 mm. The lateral offset assists the improved joint of the present disclosure resisting out-of-plane stress forces and in-plane tensile and shear forces applied, for example, to a constructed wall section in service. The improvement in resistance to the in-plane forces arises from an extended adhesive joint line within the joint profile 150, and also resistance to the out-of-plane forces arises from there being no straight fracture path between the first major faces 115, 125 and second major faces 130, 135 of the adjoined first and second building panels 110, 120.

In one embodiment, the second joint face section 170 is centrally located on first profiled side edge 140 and first joint face section 160, second joint face section 170 and third joint face section 180 have generally equal thicknesses (measured perpendicular to first major face 115), but that may be optimised for any particular application and material.

In one embodiment, the dimensions of the second joint face section 170 and second complementary joint face section 175 are predetermined such that, when brought into complementary engagement, tongue tip 195 is brought substantially into contact with groove base 190.

As shown clearly in FIG. 3A, all corner angles 162, 164, 182, 184, 192 and 194 are radiused on first side profile edge 140. Second side profile edge 145 is similarly radiused. Radii may be different for each of the corners. Typically, on a panel of thicknesses detailed above, corner radii may be in the range of 0.05 mm to 0.5 mm, and more typically 0.1-0.5 mm.

In one embodiment, the dimensions of second joint face section 170 and second complementary joint face section 175 are predetermined such that, when brought into complementary engagement, the length of tongue tip 195 is such that it does not substantially contact groove base 190, and engineered adhesive reservoir 155 is dimensioned such that there is a path for excess adhesive to migrate to the front and/or rear surfaces of join line 150 and does not "trap" adhesive in first adhesive reservoir section 240 or second adhesive reservoir section 250. The dimensions of first joint face section 160, second joint face section 170 and third joint face section 180 of first profiled edge 140, and of first complementary joint face section 165, second complementary joint face section 175 and third complementary joint face section 185 of second profiled edge 145 are formed to thickness $t_1$ such that relevant angles and dimensions are functional.

Figure 4:
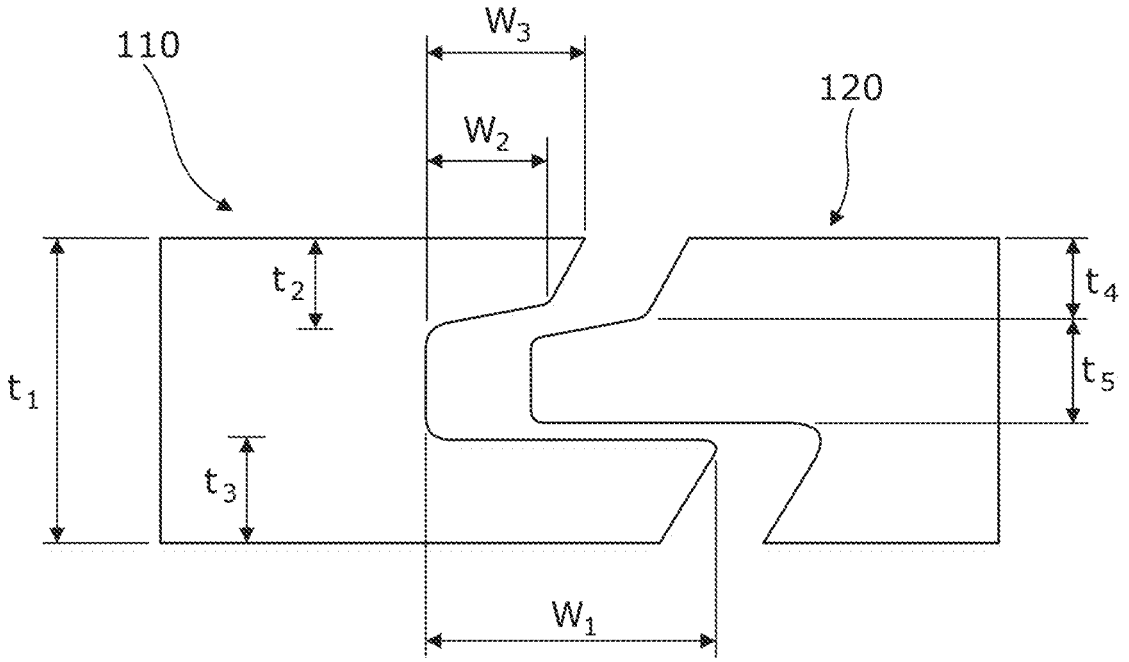
FIG. 4 is an exploded cross-sectional side view of the first and second side edge profiled of the joint profiled in complementary engagement.
Figure 5A:
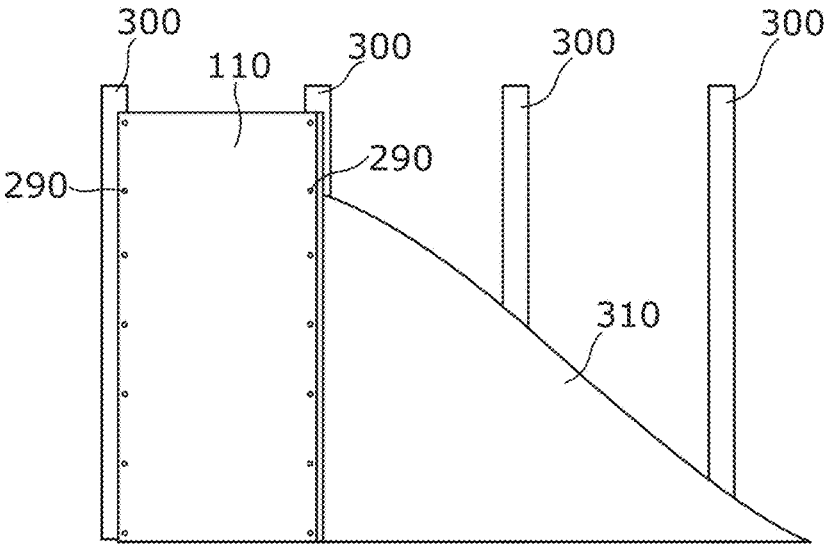
FIG. 5A is a partial cutaway front view of a building section of the present disclosure during construction.
Figure 5B:
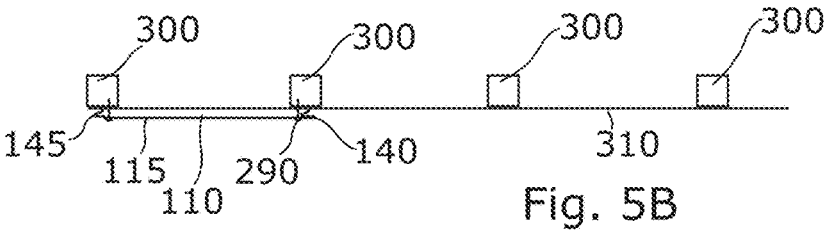
FIG. 5B is top view of partially constructed building section of FIG. 5A.
Figure 5C:
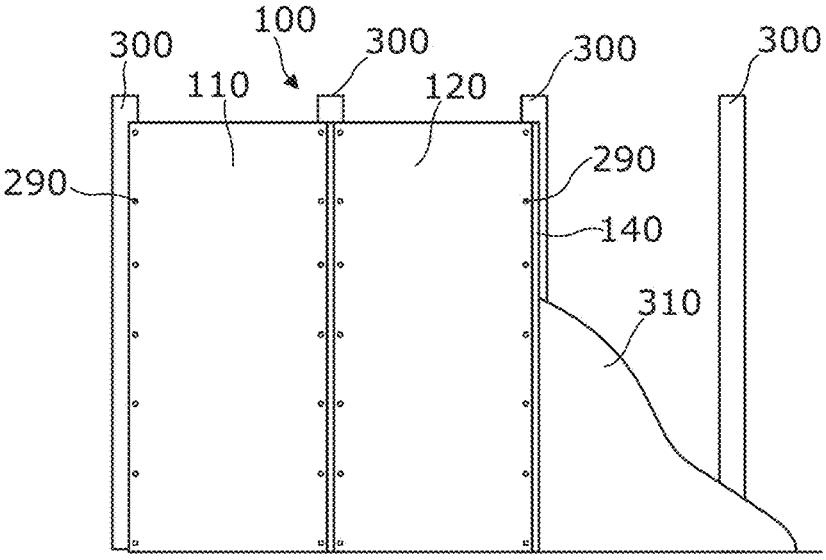
FIG. 5C is a partial cutaway front view of the building section of FIG. 5A with a further building panel in accordance with the present disclosure added.
Figure 5D:
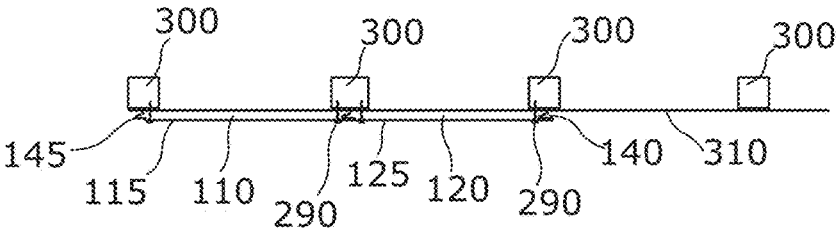
FIG. 5D is a top sectional view of a constructed building section of FIG. 5C.

FIG. 4 provides an enlarged cross-sectional view of first and second building panel 110, 120, in an exemplary embodiment in which predetermined thickness $t_1$ is approximately 10 mm. All measurements in relation to panel or panel section thickness include a +/−0.25 mm tolerance. Typically, for a fibre cement wall cladding panel product, thickness $t_1$ will be in the range of 3.5 mm to 20 mm, and more typically 6 mm to 15 mm.

Thickness $t_2$, which corresponds to the distance that corner angle 192 is from the first major face 115, is between approximately 25% and 30% of the $t_1$ thickness. In the exemplary embodiment the $t_2$ thickness is 2.75 mm. Thickness $t_3$ which corresponds to the thickness of third joint face section 180 (or the distance that corner angle 194 extends from second major face 130) is between approximately 25% and 40% of the $t_1$ thickness. In the exemplary embodiment the $t_3$ thickness is between 3 mm and 4 mm, more particularly the $t_3$ thickness of the exemplary embodiment is approximately 3.5 mm. Thickness $t_4$ which corresponds to the thickness of first complementary joint face section 165 is between approximately 20% and 30% of the $t_1$ thickness. In the exemplary embodiment the $t_4$ thickness is approximately 2.4 mm. In an alternate exemplary embodiment, the $t_4$ thickness is approximately 2.6 mm. Thickness is which corresponds to the distance from corner angle iv to corner angle γ' is between approximately 30% and 40% of the $t_1$ thickness. In the exemplary embodiment the $t_5$ thickness is approximately 3.0 mm. In an alternate exemplary embodiment, the $t_5$ thickness is approximately 3.4 mm. The configuration of the joint profile and subsequent adhesive channel and/or reservoir are modified easily by altering the dimensions of the first and second side edge profile thicknesses without impacting the structural integrity of the adhesive bond formed. FIG. 4 also shows Width $W_1$ which corresponds to the width of groove second side wall 210 which is between approximately 9 mm to 9.5 mm, and in this exemplary embodiment is approximately 9.3 mm. Width $W_2$, which corresponds to the width of groove first side wall 200, is between approximately 4 mm to 5 mm, and in this exemplary embodiment is approximately 4.2 mm. Width $W_3$, which corresponds to the width of the distance from the tip of the scarf joint to the groove base 190, is between approximately 5 mm to 6 mm, which is approximately 5.3 mm.

Referring now to FIG. 7, a further embodiment of an improved joint 450 in a building section 400 is shown. Building section 400 comprises a first building panel 410 having a first major face 415 and an opposing second major face 430 which is spaced apart from the first major face 415 by an edge member comprising first profiled side edge 440. Building section 400 further comprises a second building panel 420 wherein second building panel 420 comprises a first major face 425 and an opposing second major face 435 which is spaced apart from the first major face 425 by an edge member comprising second profiled side edge 445. First and second building panels 410, 420 are seated together in an abutting or adjoining relationship. Although not shown building section 400 can be fixed to a building structural substrate by fixings as previously described with respect to FIG. 1.

First profiled side edge 440 of first building panel 410 and second profiled side edge 445 of second building panel 420 have complementary edge profiles that are engageable to define engineered adhesive reservoir 455 therebetween. First profiled side edge 440 comprises first joint face section 460, second joint face section 470 and third joint face section 480. Second profiled side edge 445 comprises first complementary joint face section 465, second complementary joint face section 475 and third complementary joint face section 485. First joint face section 460 and third joint face section 480 are scarfed and are laterally displaced from each other.

Second joint face section 470 and second complementary joint face section 475 each comprise a tabled splice joint profile. Second joint face section 470 comprises table section 500, recess section 520 and shoulder section 490 disposed therebetween providing a transition between the table section and the recess section. Where second joint face section 470 provides a table section 500, second complementary joint face section 475 provides a corresponding and oppositely directed recess section which engages and retains table section 500 to resist in plane tensile forces.

Similarly, and with a respective oppositely directed disposition, second joint face section 470 also comprises a recess section, shoulder and table section.

Turning now to the structural adhesive that is used within the joint profile of either FIG. 1 or FIG. 7. In one embodiment, adhesive bead 280, as exemplified in FIG. 6A is a chemically curable structural adhesive such as a two-part epoxy adhesive. A structural adhesive is a load-bearing adhesive with high modulus and strength that can transmit stress without loss of structural integrity. Structural adhesives are often also referred to as high-strength or toughened adhesives. They provide strong bonds, but with some flexibility. Where complex materials, such as composite materials and/or inhomogeneous materials, are to be bonded a structural adhesive is more typically regarded as one that is able to provide a lap shear bond strength of at least 1 MPa in a standard lap shear test. Examples of suitable 2-part epoxy structural adhesives are toughened epoxy adhesives such as 3M's DP460, and DP 460 NS, and Loctite's E60 HP.

Two-part epoxy adhesives are formulated as 2-part liquid reactive polymers that undergo a chemical reaction when the two parts are mixed in their recommended volume or mass ratios. The mixed adhesive composition cures to form a solid plastic material. Structural adhesives generally provide high shear and peel strength joins, and better heat and chemical resistance than other common adhesives. In general, epoxy adhesives have the highest overall strength and offer the best performance and most resistance to high temperatures, chemicals such as solvents or salt spray and outdoor weathering.

The stronger an epoxy adhesive is formulated to be by a manufacturer, generally the more rigid the cured adhesive becomes. This may be unsuitable if the join is subject to high stress loadings, such as wind loadings or impact loadings. To improve the performance of a high strength rigid epoxy adhesive, a toughened version of the epoxy adhesives may be substituted. A toughened adhesive, such as a toughened epoxy adhesive, maintains all the advantages of high hold strength, increased energy absorption capacity, improved chemical and thermal stability, and an improved ability of the adhesive to accommodate fatigue, creep, shock and/or impact loadings. Manufacturers of epoxy adhesives can toughen adhesive formulations by incorporating materials such as ductile rubber or thermoplastic materials into epoxy's molecular backbone. For example, the ductile materials may remain in the epoxy compound as distinct phases, providing a mechanism by which the softer toughening phase can better absorb shear or impact forces compared to a similar but untoughened adhesive. Carboxyl terminated butadiene-acrylonitrile (CTBN) copolymers are an example of a family of ductile materials used in toughened epoxies.

As an example, the families of compounds used in a typical two part toughened 2-part epoxy adhesive composition are shown below:

Part A

TABLE 1

| Ingredient | % by Wt |
|---|---|
| Diamine | 45-79 |
| Epoxy Resin | 10-30 |
| Modified Diglycidyl Ether of Bisphenol A | 7-13 |

TABLE 1-continued

| Ingredient | % by Wt |
|---|---|
| Amorphous Silica | 3-7 |
| (Dimethylamino-Methyl)Phenol | 1-5 |

Part B

TABLE 2

| Ingredient | % by Wt |
|---|---|
| Epoxy Resin | 85-92.8 |
| Acrylic Polymer | 7-13 |
| di-tert-Butyl-p-Cresol | 0.1-1 |
| Glycidyl Ether | 0.1-1 |

For a formulation such as one in the range provided above in Tables 1 and 2, there is usually a specified ratio of mixing Part A and Part B to achieve an optimised result in the cured adhesive. Curing begins as soon as Part A and Part B are mixed together. Curing is not instantaneous, and manufacturers provide a Technical Data Sheet for any commercially available product, nominating the nominal "working time" or "pot life" for the adhesive, once the parts are combined. The working life, or pot life, is the time it takes for the curing adhesive to reach an unusably high viscosity.

Control of the Part A: Part B mixing ratios can be controlled by manufacturers by means of packaging. In particular, a dual cartridge or dual syringe system can be used where the nozzle or dispenser configurations are designed to deliver the correct volume or weight ratios of each part. Some delivery systems include a mixing barrel so that Part A and Part B are also mixed together during dispensing, eliminating variability at the end user level.

As an example of the performance achievable by a toughened epoxy adhesive, such as 3M's DP460, Table 3 provides results for lap shear tests on aluminium substrates. The tests show two toughened epoxy adhesives cured between two pieces of aluminium to form a standard lap shear test. The adhesives have lost less than 30% of their strength under accelerated testing, reflecting that long-term performance can be expected to be maintained during service in an installed improved building joint.

TABLE 3

| Environment | Condition | DP460 | DP460NS |
|---|---|---|---|
| 23 C./50% RH | ambient | 36 MPa | 38 MPa |
| Distilled Water | 30 Day immersion | 35 MPa | 31 MPa |
| Water Vapour | 49 deg C./100% RH @ 30 days | 31 MPa | 27 MPa |
| Isopropanol | 23 deg C., 30 days immersion | 39 MPa | 37 MPa |
| MEK | 23 deg C., 30 days immersion | 29 MPa | 28 MPa |
| Salt Spray | 5% by wt concentration, 35 deg C., 30 days | 35 MPa | 36 MPa |

Alternate two-part epoxy adhesives include DP460NS, DP420, and DP420NS available from 3M in either pigmented or unpigmented form, and E60HP and 20HP available from Loctite.

Other toughening methods can rely on specific diluents, plasticisers, and/or other reactive elements to change the epoxy's molecular structure in ways that make it more flexible. For example, by reducing the crosslink density or by shortening molecular chains. Amine-Terminated Butadiene Acrylonitrile (ATBN), Hydroxyl-Terminated Polybutadiene (HTPB), Epoxy-terminated liquid rubbers, Poly(siloxane)s, Fluoro-elastomers, Acrylated elastomers, Amine terminated silicone oligomers, Polysulfone (PSF)-modified epoxies, Functionally terminated polyether ether ketone, Block-copolymer-modified epoxy Other methods rely on the addition of particulate matter. For example, rigid crystalline polymers (such as zirconia-containing ceramics), core-shell particles (thermoplastic particles with a glassy shell), nanoparticles including CaSiO3, alumina, nano TiO2, nano ZnO, nano SiO2 and nanoclays.

In one embodiment, the structural or high strength adhesive is a two-part epoxy adhesive where an alternative to an amine component is used. For example, polyamide, mercaptan, polysulfide, imidazole, novolac, acid anhydrate, carboxylic acid, or isocyanate based alternatives may be used.

In one embodiment, the structural or high strength adhesive is a 2-pack polyurethane adhesive.

In one embodiment, the structural or high strength adhesive is a moisture cured polyurethane adhesive.

In one embodiment, the structural or high strength adhesive is a chemically curable acrylic adhesive.

In one embodiment, the structural or high strength adhesive is a chemically curable silyl modified polyester.

A chemical curing adhesive is selected because of the performance benefits compared to more traditional means of forming building joints includes mechanical fixing means to the building substructure and obscuring of the join via filling the join line with a gyprock based or latex based joint filling compound. During its service life, a building section may undergo various types of stresses, such as, out-of-plane stresses from dynamic loadings such as wind loading, earthquakes and impacts; dynamic and static loadings from stresses such as snow loads, thermal and moisture effects; and in-plane shear stresses such as wind loading and earthquakes. Where building panels are fixed to a building substructure, such as a building frame, adjacent each other via a mechanical fixing means such as nails or screws, there is a limited ability of the constructed building section to withstand at least some service stresses. In particular, in-plane shear forces.

The joint design of the present disclosure including the engineered adhesive reservoir capable of accepting and retaining at least a portion of the structural adhesive, is designed to accommodate a range of in-service stresses such as out-of-plane stresses, axial loadings, and in-plane shear stress loadings without enabling failure structural of the adhesive due to cracking or distortion.

In a constructed building section, adhesive 280 is selected so that its bond strength under the applied stress type is approximately equal to that of the building panel. In this way, it is understood that the cured joint is not the weakest point in the building section 100 and any failure will not occur at the joint line 152.

Referring now to FIGS. 5A to 5D and 6A to 6D, the method to construct building section 100 will now be described. The method comprises the steps of:— installing framing members 300 to provide building structural support; optionally installing building wrap 310; Installing first building panel 110 by fixing to at least one framing member of building structural support; applying adhesive bead 280 to groove base 190 of first profiled edge 140; Inserting second profiled edge 145 of second building panel 120 into first profiled edge 140 of first building panel 110 and urging second profiled edge 145 into a complementary engagement with first profiled edge 140 thereby urging adhesive bead 280 to deform and flow to at least substantially fill engineered adhesive reservoir 155 and become adhesive mass 285, fixing second building panel 120 to at least one framing member 300 of building structural support.

Building structural support comprises one or more framing members 300, fixed together in a predefined arrangement and is generally installed on, and secured to, a foundation layer such as a concrete slab, or piers or the like. The dimensions of individual framing members 300 will generally be prescribed by national, regional and/or local building codes or regulations. Fixing types used to secure framing members together and/or to the foundation layer may also be specified, based on the building type, applied loads, climate zones, and the like.

Building paper 310, also known as building wrap, may optionally be installed between the cladding layer and the building structural substrate. Building wrap 310 is intended to provide additional protection against liquid water, such as from ingress of wind driven rain, through exterior cladding until it contacts a building frame where it may cause durability issues if it is resident there over extended periods of time. An example of such a product is Hardiewrap, available from James Hardie. Hardiewrap is a breathable non-woven polyolefin sheet, which prevents transmission of liquid water, but allows for transmission of water vapour, thereby allowing any water trapped against the frame to dry out over time. The building paper or building wrap is installed by nailing at predetermined intervals to building structural substrate, as per manufacturer's installation instructions.

Installing first building panel 110 by fixing to at least one framing member 300 of building structural support; A first building panel 110 is installed into a predetermined position by fixing it to building structural support 300 using mechanical fasteners 290 such as nails or screws. Fixing types may be specified by national, regional or local building codes or regulations. Vertical framing members 300 also referred to as studs, are also spaced apart in accordance with national, regional and/or local building codes and regulations. Centre-to-centre stud spacings are such that the width of first building panel 110 and any subsequent building panel to be installed, such as second building panel 120, will span the distance between two adjacent studs or will span the centre-to-centre distance across three or more adjacent studs. Commonly, a single building panel will span centre-to-centre across three adjacent studs. In such an installation, first building panel 110 is positioned such that profiled side edge 140 is aligned to the centre longitudinal axis of the stud and fixed into position by nailing or screwing. Care should be taken during installation to account for any inconsistencies in building structural substrate 300 so that installed building panels are aligned to a predetermined installation arrangement.

The selected adhesive is applied as adhesive bead 280 to groove base 190 of first profiled edge 140 of first building panel 110. If the adhesive is a two-part chemical curing adhesive that is available pre-packaged in a self-mixing applicator, such as a dual barrel syringe with a self-mixing tip, the adhesive is mixed as it is being dispensed. To apply the adhesive to groove base 190, the applicator tip of the adhesive dispenser is positioned at one end of the groove and pressure is applied to the adhesive dispenser to cause the adhesive to exude from the applicator. The installer moves their hand towards the other end of the groove as the adhesive exudes from the applicator and results in adhesive bead 280 applied evenly along the length of groove base 190. Some adhesive applicators, such as self-mixing applicators are sized such that a full syringe of adhesive is sufficient to provide an evenly distributed adhesive bead 280 of consistent diameter along the full length of groove base 190 of profiled side edge 140. Other dispenser types and applicators are suitable for use so long as they can deliver an adhesive bead along the length of first profiled side edge 140. It is not essential that adhesive bead is applied into groove base 190. Adhesive bead 280 may alternately be applied to cover the entire surface of first profiled side edge 140. Alternately, adhesive bead 280 may be applied along the length of second profiled side edge 145 of second building panel 120, either to tongue tip 195 or to another area of second profiled side edge 145 or to the entire surface of second profiled edge 145. In a typical vertical install pattern, application of adhesive bead 280 may begin from the bottom end of the groove and progress towards the top edge, or vice versa if the building panels are installed each with their respective long axis oriented vertically. In an alternate arrangement, building panels 110,120 may also be installed with their respective long axis oriented horizontally, either with panel ends in adjacent rows aligned, or with panel ends in adjacent rows laterally offset, in a pattern commonly referred to as a staggered or "brick pattern" arrangement.

Once adhesive bead 280 has been applied to groove base 190 of first profiled side edge 140, second building panel 120 must be brought into an engaging alignment such that second profiled edge 145 of second building panel 120 is aligned with corresponding opposing first profiled side edge 140 first building panel 110. Second profiled edge 145 of second building panel 120 is brought into complementary engagement with first profiled edge 140 of first building panel 110 thereby forcing adhesive bead 280 to deform and flow into, and at least substantially fill, engineered adhesive reservoir 155 resulting in structural adhesive mass 285 within engineered adhesive reservoir 155. Any excess adhesive overfill 287 can be removed (shown in FIG. 6C) or, spread along front face 115 of first major face of first building panel 110 and first major face 125 of second building panel 120 adjacent joint line 150 to form adhesive skin 288 (shown in FIG. 6D).

Once adhesive bead 280 has been deformed and urged into substantially filling adhesive reservoir 155, second building panel 120 is fixed into position to at least one framing member of building structural support 300.

Structural adhesive mass 285 is allowed to cure by chemical curing prior to any optional secondary surface treatments such as paint, render, and the like are applied.

Optional secondary surface treatments such as painting, rendering, tiling, and the like may be carried out on the constructed building section once the construction method has been completed.

Referring now to FIGS. 8A to 8D, one embodiment of the method to construct building section 100 comprising off-stud joints will now be described. Off-stud joints are generally understood to be joints that are not positioned over framing members.

The method for installing the building panels of the present disclosure in an off-stud building section generally comprises the steps of: —installing framing members 300 to provide building structural support; optionally installing building wrap 310; Installing first building panel 110 by fixing in a predefined position to at least one framing member of building structural support such that neither first profiled side edge 140 nor second profiled edge 145 are supported by framing member 300 but are each intermediate respective adjacent framing member locations; applying adhesive bead 280 to groove base 190 of first profiled edge 140; Inserting second profiled edge 145 of second building panel 120 into first profiled edge 140 of first building panel 110 and urging second profiled edge 145 into a complementary engagement with first profiled edge 140 thereby urging adhesive bead 280 to deform and flow to at least substantially fill engineered adhesive reservoir 155 and become adhesive mass 285, fixing second building panel 120 to at least one framing member 300 of building structural support. The steps of the method of installing the building panels will be described in more detail below.

Building structural support comprises one or more framing members 300, fixed together in a predefined arrangement and is generally installed on, and secured to, a foundation layer as described above. The dimensions of individual framing members 300 and fixing types used to secure framing members together and/or to the foundation layer are also as described above. Vertical framing members 300 also referred to as studs, are also spaced apart in accordance with national, regional and/or local building codes and regulations.

Building paper 310, also known as building wrap, may optionally be installed between the cladding layer and the building structural substrate as described above.

Installing first building panel 110 by fixing to at least one framing member 300 of building structural support such that first profiled edge 140 and second profiled edge 145 are intermediate respective adjacent framing members 300. With specific reference to FIGS. 8A and 8B, an alternate off-stud building section is exemplified in which first building panel 110 is an end building panel in the building section. As such, second profiled edge 145 of first building panel 110 is shown adjacent to first framing member 300 whereby the first building panel 110 is secured to the first framing member 300 using fastening members 290. The opposite first profiled edge 140 of first building member 110 is located between the second and third framing members 300. First building panel 110 is installed into a predetermined position by fixing it to building structural support 300 using mechanical fasteners 290 such as nails or screws. Fixing types may be specified by national, regional or local building codes or regulations.

Figure 8A:
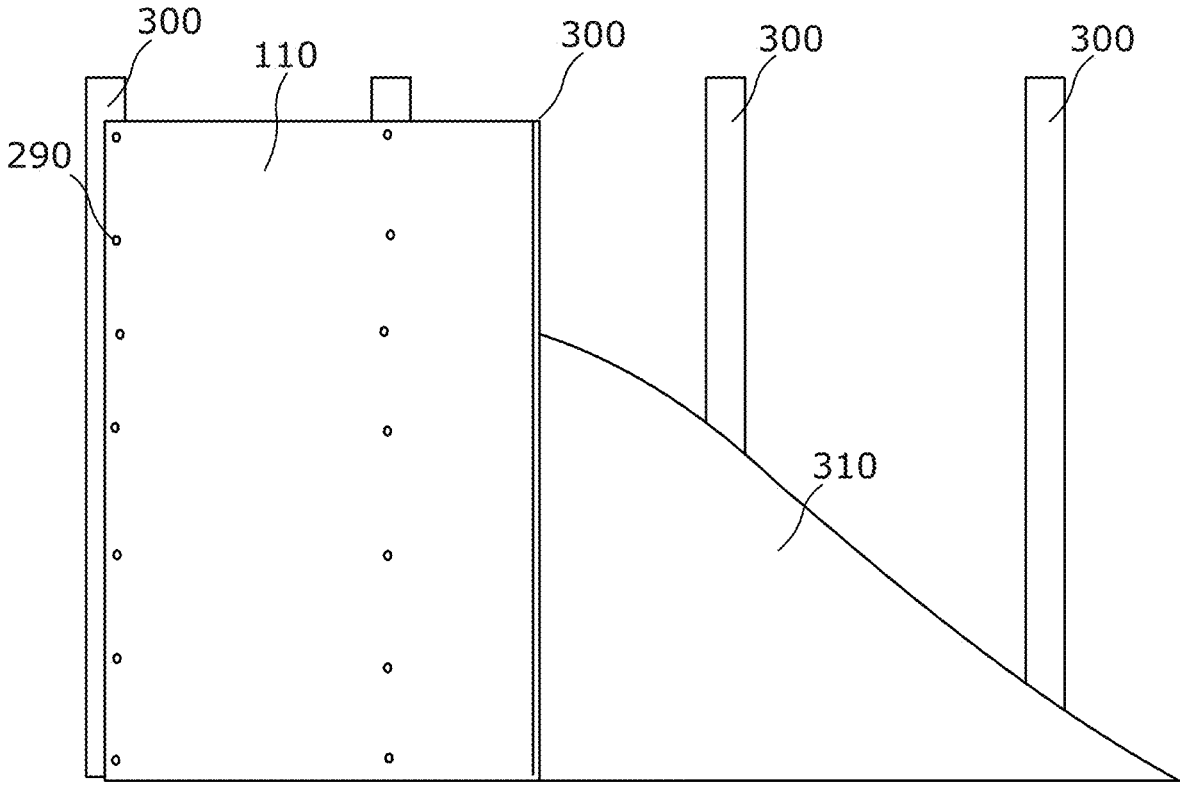
FIG. 8A is a partial cutaway front view of a building section of one embodiment of the present disclosure during construction.
Figure 8B:
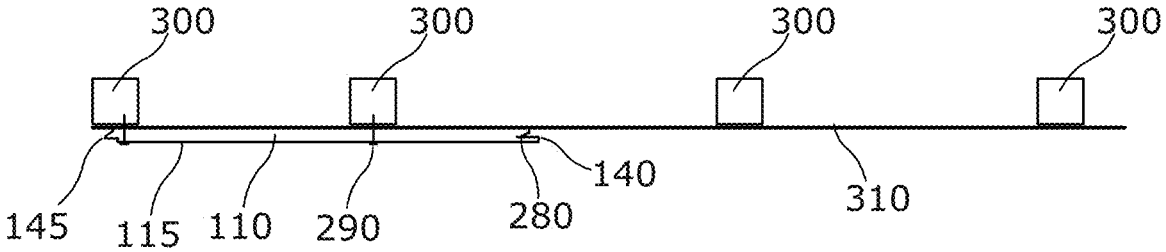
FIG. 8B is top view of partially constructed building section of FIG. 8A.
Figure 8C:
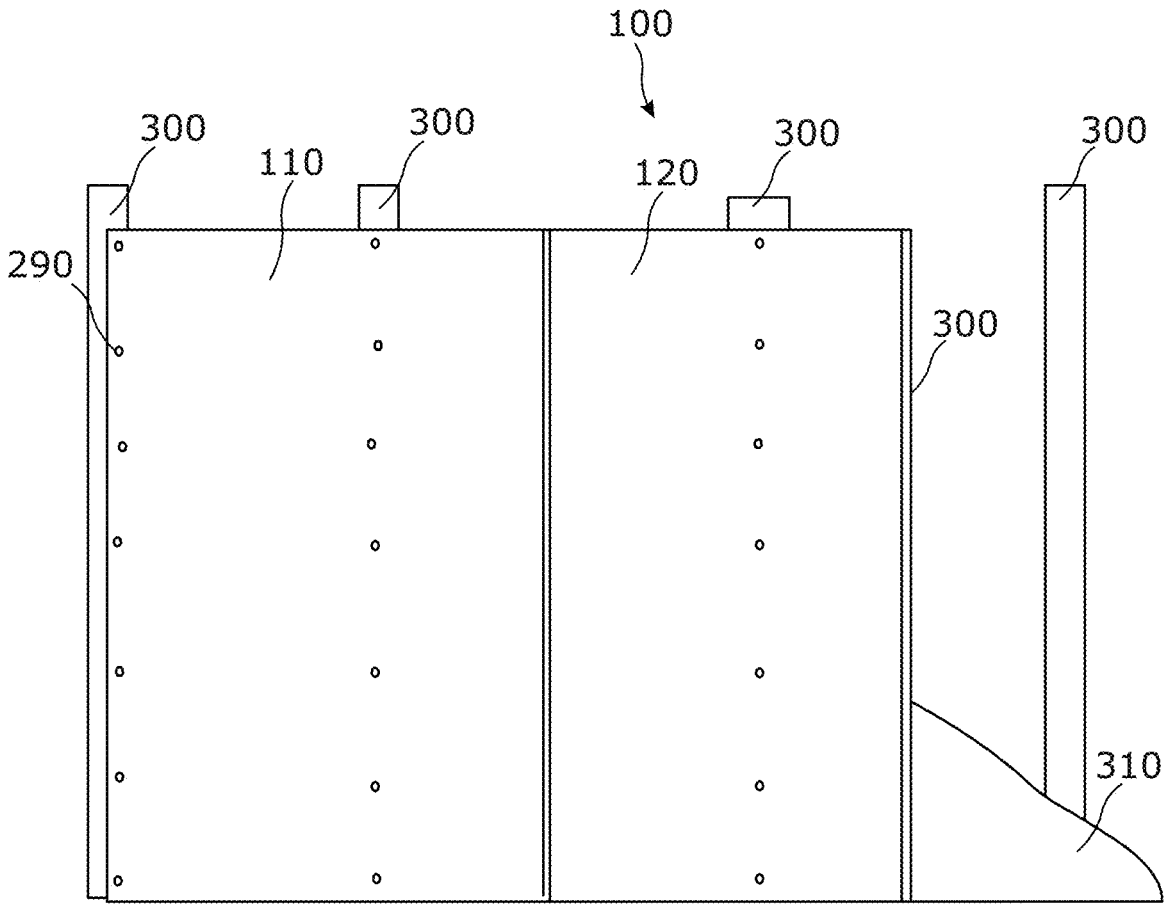
FIG. 8C is a partial cutaway front view of the building section of FIG. 8A with a further building panel in accordance with the present disclosure added.
Figure 8D:
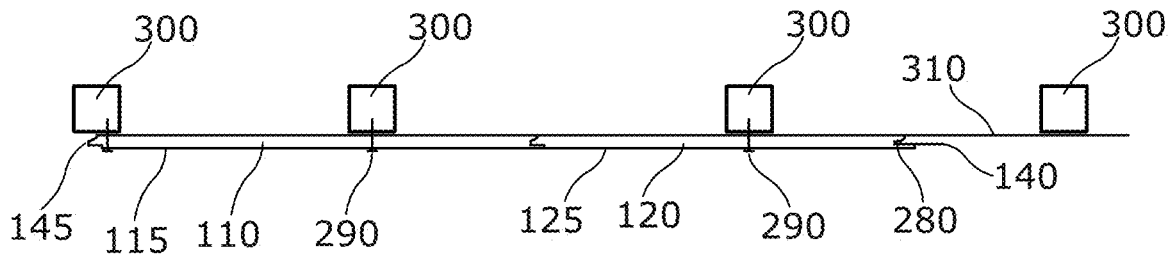
FIG. 8D is a top sectional view of a constructed building section of FIG. 8C.

Referring now, to FIGS. 8C and 8D, second building member 120 when installed in complementary engagement with first building member 110 is attached in an off-stud configuration whereby both first and second profiled edges 140, 145 are located between subsequent framing members 300. Centre-to-centre stud spacings are such that the width of first building panel 110 and any subsequent building panel to be installed, such as for example, second building panel 120, will span the distance between two adjacent studs or will span the centre-to-centre distance across three or more adjacent studs. Subsequent building members will also be attached in an off-stud configuration.

It is sometimes preferred for a single building panel to span centre-to-centre across three adjacent studs. In such an installation, first building panel 110 is positioned such that centre longitudinal axis is aligned to the centre longitudinal axis of the stud and fixed into position by nailing or screwing. Care should be taken during installation to account for any inconsistencies in building structural substrate 300 so that installed building panels are aligned to a predetermined installation arrangement.

The selected adhesive is applied as adhesive bead 280 to groove base 190 of first profiled edge 140 of first building panel 110 as described above.

Once adhesive bead 280 has been applied to groove base 190 as described above, second building panel 120 must be brought into an engaging alignment such that second profiled edge 145 of second building panel 120 is aligned with corresponding opposing first profiled side edge 140 first building panel 110. Second profiled edge 145 of second building panel 120 is brought into complementary engagement with first profiled edge 140 of first building panel 110 thereby forcing adhesive bead 280 to deform and flow into, and at least substantially fill, engineered adhesive reservoir 155 resulting in structural adhesive mass 285 within engineered adhesive reservoir 155 as described above. Any excess adhesive overfill 287 can be removed or, spread along front face 115 of first major face of first building panel 110 and first major face 125 of second building panel 120 adjacent joint line 150 to form adhesive skin 288.

Once adhesive bead 280 has been deformed and urged into filling adhesive reservoir 155, second building panel 120 is fixed into position to at least one framing member of building structural support 300.

Structural adhesive mass 285 is allowed to cure by chemical curing prior to any optional secondary surface treatments such as paint, render, and the like are applied.

Optional secondary surface treatments such as painting, rendering, tiling, and the like may be carried out on the constructed building section once the construction method has been completed.

EXAMPLES

All examples provided hereafter use a fibre cement board having a thickness $t_1$ of 10 mm+/−A double scarfed tongue and groove joint profile was created by machining a complementary edge profile in each respective side edge of a plurality of fibre cement building panels. The complementary edge profiles are shown in the figures included in this application as first profiled edge 140 and second profiled edge 145.

In each of the examples that follow, first profiled edge 140 and second profiled edge 145 have the approximate dimensions shown below.

Groove base 190 is approximately 3 mm wide (between groove first side wall 200 and groove second side wall 220. The thickness from second major face 130 to groove second side wall is approximately 3.5 mm+/−0.1 mm. The thickness between first major face 115 and groove first side wall is also approximately 3.5 mm+/−0.1 mm. The distance from groove base 190 to the furthest extent of first radius 162 is approximately 5.3 mm+/−0.1 mm and the distance from groove base 190 to the furthest extension of third radius 182 is approximately 9.7 mm+/−0.1 mm.

Angle $\alpha$ is approximately 25 degrees, Angle $\beta$ is approximately 110 degrees, and angle $\gamma$ is approximately 25 degrees.

Complementary second profiled edge 145 is positioned such that, when brought into complementary engagement, first adhesive reservoir section 240 is approximately 0.5 mm wide between groove first side wall 200 and tongue first side edge 220; second adhesive reservoir section 250 is approximately 0.5 mm+/−0.1 mm wide between groove second side wall 210 and tongue second side edge 230. First adhesive channel 260 between first joint face section 160 and first complementary joint face section 165; and second adhesive channel 270 between third joint face section 180 and third complementary joint face section 185 are both 0.2 mm+/−0.1 mm wide.

For an embodiment where tongue tip 195 and groove base 190 are substantially in contact, the gap between tongue tip 195 and groove base 190 is 0.2 mm+/−0.1 mm.

Examples—Joint Strength

Two sample pieces of medium density fibre cement each have one edge machined to form a respective first profiled edge and second profiled edge as detailed above.

Onto groove base 190 of first building panel 110, a bead of adhesive DP260 is run along the length of the groove. The diameter of the adhesive bead should be sufficient that, at each point along the length of first profiled edge 140, there is enough adhesive to at least completely fill engineered adhesive reservoir 155 when second profiled edge 145 of second building panel 120 is brought into complementary engagement with first profiled edge 140.

Excess adhesive that exudes out of first adhesive channel 260 at joint line 150 can be removed by wiping. Care is taken to ensure that the join is maintained in close contact, and samples are left undisturbed for sufficient time for the adhesive to chemically cure according to the manufacturer's instructions.

Strength tests results for in-plane tensile and shear tests and out-of-plane flexure tests are provided below in Table 4.

TABLE 4

TEST RESULTS

| Example | Flexure (MPa) | Tensile (MPa) | Shear (MPa) |
|---|---|---|---|
| Control (Building panel) (avg of 12 tests) | 12.7 | 7.3 | 7.6 |
| Example A (avg of 12 tests) | 12.4 | 6.1 | 6.5 |
| Example B (avg of 12 tests) | 12.8 | 6.0 | 6.6 |

Joint Strengths are compared to the results of a standard 4-point bend test for a medium density fibre cement product of comparable thickness as the Control. Compared to a standard butt join or a basic shiplap join in a building section, neither of which can provide resistance to in-plane and out-of-plane forces, the improved join of the present disclosure provides "out-of-plane" flexural strength comparable to the strength of the building panels being bonded, and "in-plane" tensile and shear forces approaching those of the building panels being bonded.

Examples—Bending Moment Under Uniformly Distributed Load for Off-Stud Joined Panels Bending moments have been calculated for 1200 mm wide building panels installed onto timber framing elements (studs) 300 spaced 600 mm apart on a timber frame. The calculated bending moments have been exemplified in FIGS. 9A to 9C respectively as beam models in accordance with first design principles. The uniformly distributed load is applied in the direction indicated by arrows 900. The represented bending moments experienced by the building cladding panels are illustrated as a directional extension from a neutral axis which corresponds to the plane of the building panels attached to the structural building fame.

Points of inflection in which, the forces experienced by the building cladding panels are equal, are shown as zero on the neutral axis.

Figure 9A:
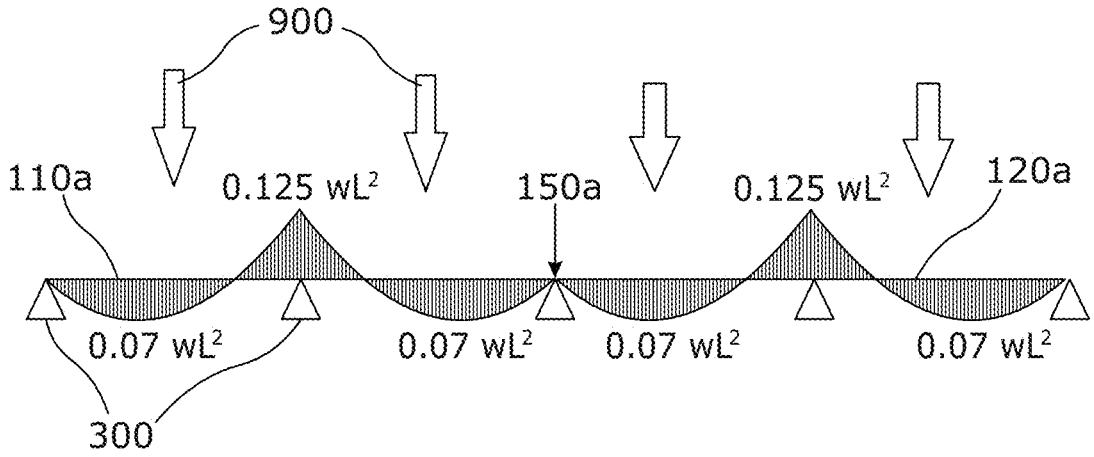
FIGS. 9A to 9C are representations of three exemplary bending moments0 under uniform distributed load.

In each of the calculations, a building cladding panel has been fixed to a timber stud along its long centre axis as further described in the following. In FIG. 9A, there is shown, a first exemplary calculation in which two building panels 110*a* and 120*a* have been positioned on the timber frame such that the first and second building panels 110*a* and 120*a* are secured to timber studs 300 in a non-interlocking butt joint arrangement. In the configuration shown in FIG. 9A, first and second building panels 110*a* and 120*a* are joined on the central stud at position 150*a*. No adhesive has been applied to the joint between the adjacent panels. Hereinafter this is referred to as a discontinuous join, wherein a discontinuous join is one where adjacent panels are joined by physical engagement only and no adhesive is used.

Figure 9B:
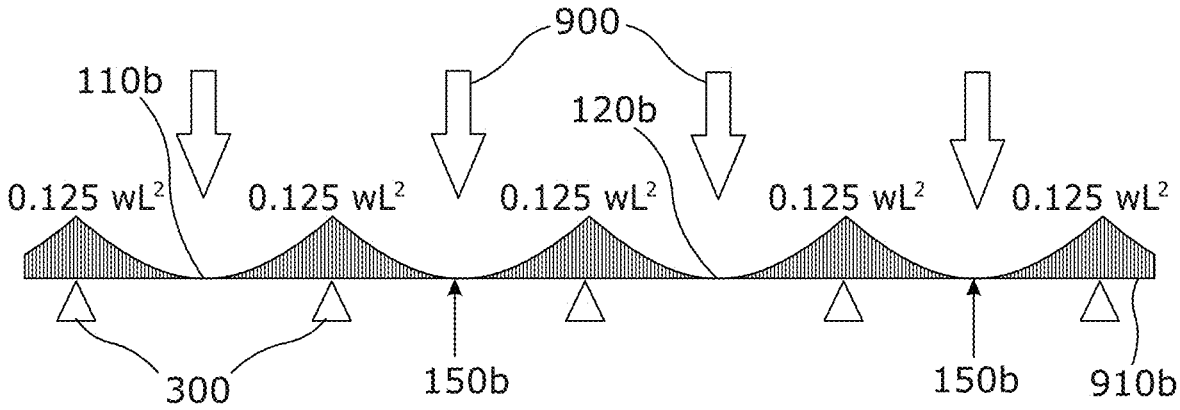

In FIG. 9B, there is shown, a second exemplary calculation in which three building panels 110*b* 120*b* and 910*b* have attached to the timber frame in an off-stud arrangement such that the such that the building panels 110*b*, 120*b* and 910*b* are secured to timber studs 300 in a non-interlocking butt joint arrangement. In the configuration shown in FIG. 9*b*, second building panel 120*b* is joined to each of first building panel 110*b* and third building panel 910*b* at joints 150*b* which are also positioned between studs 300. No adhesive has been applied to the joint between the adjacent panels. Thus the join between adjacent panels is a discontinuous join. It should be understood, that it is also possible to use an interlocking joint such as, for example a simple tongue and groove, such interlocking designs when forming a discontinuous join would offer negligible flexure resistance under applied load, thus their contribution to the bending moment diagram is negligible.

Figure 9C:
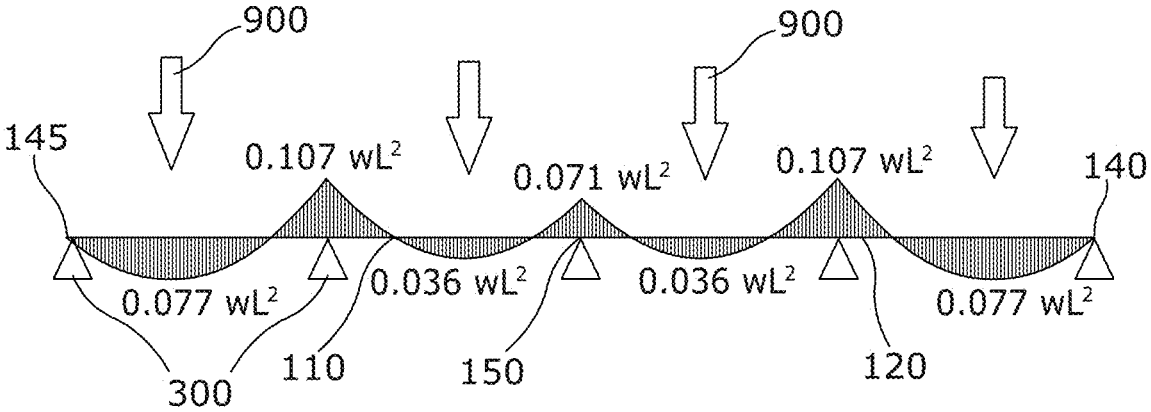

In FIG. 9C, there is shown, a third exemplary calculation in which building panels 110 and 120 comprise the joint configuration of the present disclosure and in which building panels 110 and 120 have been fused together using the structural adhesive of the present disclosure. In the configuration shown in FIG. 9C, first building panel 110 and second building panel 120 are joined together at joint 150. Each joint profile comprises a hybrid joint profile comprising two scarfed joint sections disposed on either side of a tongue and groove joint section. Thickness $t_1$ of first and second building panels 110, 120 is approximately 10 mm, whilst thickness $t_2$ is approximately 2.75 mm, thickness $t_3$ is approximately 3.5 mm, thickness $t_4$ is approximately 2.6 mm and thickness $t_5$ is approximately 3.4 mm. Width $W_1$ is approximately 9.3 mm, width $W_2$ is approximately 4.2 mm and width $W_3$ is approximately 5.3 mm. The structural adhesive is one that is able to provide a lap shear bond strength of at least 1 MPa in a standard lap shear test.

A summary of the results are shown below in Table 5. In the table, w=uniformly distributed load per unit span; and L=Span (stud spacing), typically 600 mm. Negative results indicate a bending moment of the panel front face away from the neutral axis. Positive results indicate a bending moment in the opposite direction.

TABLE 5

| Join Type | Bending moment at Join | Bending moment at framing element |
|---|---|---|
| On stud, discontinuous join | $-0.07\ wL^2$ | $0.125\ wL^2$ |
| Off-stud, discontinuous join | $0\ wL^2$ | $0.125\ wL^2$ |
| Off-stud, High Strength Join | $-0.036\ wL^2$ | $0.071\ wL^2$ |

The maximum bending moment under uniform distributed load experienced by the on-stud and off-stud join positioning as illustrated in FIGS. 9A and 9B was similar where the panels were attached to an intermediate stud between the joint locations. In contrast at a similar location, the maximum bending moment under uniform distributed load experienced by the off-stud fused joint configured in accordance with the present disclosure was reduced by 14.4% when compared to an off-stud, discontinuous join where no adhesive was used. The illustrated bending moment calculations clearly show improved dissipation of the applied uniform distributed load across multiple fused panels of the improved building section comprising the fused joint of the present disclosure in an off-stud arrangement relative to the other systems comprising panels with a discontinuous join in either an on-stud or off-stud arrangement. Panel deformation under uniform distributed load will be correspondingly lower for off-stud, high strength joins compared to panels of either comparative example with discontinuous joins, thereby providing improved performance, particularly during service life of the installation.

Certain features that are described in this disclosure in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations, one or more features from a claimed combination can, in some cases, be excised from the combination, and the combination may be claimed as any sub-combination or variation of any sub-combination.

Some embodiments have been described in connection with the accompanying drawings. The figures are drawn to scale, but such scale should not be limiting, since dimensions and projections other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practised using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Language of degree used herein, such as the terms 'approximately', 'about', 'generally' and 'substantially' as used herein represent a value, amount, or characteristic close to the stated value, amount or characteristic that still performs a desired function or achieves a desired result. For example, the terms 'approximately', 'about', 'generally' and 'substantially' may refer to an amount that is within less than or equal to 10% of, within less than or equal to 5% of, within less than or equal to 1% of, and within less than or equal to 0.1% of the stated amount.

It will of course be understood that the invention is not limited to the specific details described herein, which are given by way of example only, and that various modifications and alterations are possible within the scope of the disclosure as defined in the appended claims.

What is claimed is:

1. A joint in a building section comprising:

a building substructure;

a first building panel and at least a second building panel wherein the first and at least second building panel are fixed to the building substructure in a predetermined arrangement, each of the first and at least second building panel comprising a first profiled side edge and a second profiled side edge wherein the first and second profiled side edges are opposing side edges and are of complementary configuration such that the first profiled side edge of the first building panel is configured to cooperate in a mating relationship with the second profiled side edge of the at least second building panel thereby forming a hybrid joint profile comprising at least one scarfed joint section and at least one interlock joint section, the first profiled edge of the first building panel being laterally offset from the second profiled side edge of the second building panel to form an engineered adhesive reservoir therebetween when the first profiled side edge and second profiled side edge are interfit in a mating relationship, wherein the engineered adhesive reservoir is continuous and interconnected and extends continuously along the at least one scarfed joint section and the at least one interlock joint section;

a structural adhesive wherein the structural adhesive is located within the engineered adhesive reservoir; and wherein the engineered adhesive reservoir comprises a gap comprising at least one adhesive reservoir section and at least one adhesive channel that are interconnected, and the gap forms a continuous pathway and is configured to accumulate and store the structural adhesive such that the structural adhesive can distribute within the at least one scarfed joint section and the at least one interlock joint section.

2. The joint of claim 1, wherein the joint profile comprises two scarfed joint sections.

3. The joint of claim 1, wherein the interlock joint section comprises a tongue and groove joint section.

4. The joint of claim 1, wherein the interlock joint section comprises a tabled splice joint section.

5. The joint of claim 1, the hybrid joint profile comprising at least two scarfed joint sections and at least an interlock joint section wherein the interlock joint section is either a tabled splice joint section or a tongue and groove joint section wherein at least two scarfed joint sections are spaced apart from each other and the interlock joint section is intermediate the spaced apart at least two scarfed joint sections.

6. The joint of claim 1, wherein the engineered adhesive reservoir comprises at least a first and a second adhesive reservoir section, wherein the first adhesive reservoir section is configured to receive a bead of the structural adhesive in a manner such that the bead of the structural adhesive can deform and flow to the second adhesive reservoir section.

7. The joint of claim 1, wherein the structural adhesive comprises a toughened epoxy.

8. The joint of claim 1, wherein the first building panel and the second building panel are fibre cement building panels.

9. The joint of claim 1, wherein the first building panel further comprises an aesthetic finish on at least a section of at least one major face, wherein the aesthetic finish comprises a decorative finish.

10. The joint of claim 9, wherein the aesthetic finish is a printed aesthetic finish.

11. The joint of claim 9, wherein the aesthetic finish is an embossed aesthetic finish.

12. The joint of claim 9, wherein the aesthetic finish is an integrally formed aesthetic finish.

13. The joint of claim 9, wherein the aesthetic finish is a machined aesthetic finish.

14. The joint of claim 1, wherein the first profiled side edge of one or more further installed building panels and the second profiled side edge of one or more additional further installed building panels are unsupported by framing members of the building substructure, and are disposed intermediate to respective adjacent framing members of the building substructure.

15. The joint of claim 1, wherein the engineered adhesive reservoir is in the form of an indirect or contorted continuous pathway between opposing major faces of the first building panel and the second building panel.

16. A method of installing a building section, the method comprising:

a. providing a building structural support;

b. providing a first building panel comprising a first and a second profiled side edge and installing the first building panel by fixing the first building panel to the building structural support in a predetermined position;

c. applying an uncured structural adhesive to the first profiled side edge of the first building panel;

d. providing a second building panel comprising a first and a second profiled side edge and installing the second building panel by:

i. positioning its complementary profiled second profiled side edge with the first profiled side edge of the first building panel to form a hybrid joint profile comprising at least one scarfed joint section, at least one interlock joint section, and an engineered adhesive reservoir that is continuous and interconnected and extends continuously along the at least one scarfed joint section and the at least one interlock joint section, wherein the engineered adhesive reservoir comprises a gap comprising at least one adhesive reservoir section and at least one adhesive channel that are interconnected, and the gap forms a continuous pathway and is configured to receive and store the uncured structural adhesive;

ii. aligning the second building panel to a predetermined position, iii. urging the second profiled side edge of the second building panel and the first profiled side edge of the first building panel together so that the uncured structural adhesive stored in the engineered adhesive reservoir can be distributed within the at least one scarfed joint section and the at least one interlock joint section, forming a joint line between the first and second building panels, and iv. fixing the second building panel to the building structural support in a predetermined position;

and e. allowing the structural adhesive to cure.

17. The method of claim 16, wherein any excess structural adhesive is removed by wiping or scraping away from the joint line.

18. The method of claim 16, wherein any excess structural adhesive is spread along a face of the building panels adjacent the joint line.

19. The method of claim 16, wherein, in the predetermined position, the first profiled side edge of one or more further installed building panels and the second profiled side edge of one or more additional further installed building panels are unsupported by framing members of the building structural support, and are disposed intermediate to respective adjacent framing members of the building structural support.

* * * * *